United States Patent [19]

Okamoto et al.

[11] 4,008,344

[45] Feb. 15, 1977

[54] MULTI-COMPONENT FIBER, THE METHOD FOR MAKING SAID AND POLYURETHANE MATRIX SHEETS FORMED FROM SAID

[75] Inventors: Miyoshi Okamoto, Takatsuki; Koji Watanabe, Otsu; Zenji Izumi; Toshihiko Aya, both of Nagoya; Hideaki Kitagawa, Otsu, all of Japan

[73] Assignee: Toray Industries, Inc., Tokyo, Japan

[22] Filed: Nov. 28, 1975

[21] Appl. No.: 636,063

Related U.S. Application Data

[63] Continuation of Ser. No. 457,542, April 3, 1974, abandoned.

[30] Foreign Application Priority Data

Apr. 5, 1973 Japan ..... 48-38218

[52] U.S. Cl. ..... 427/307; 28/75 R; 28/76 T; 264/171; 264/176 F; 264/210 F; 427/353; 427/401; 428/288; 428/290; 428/370; 428/373; 428/425

[51] Int. Cl.[2] ..... B05D 3/10; D01F 8/10; D01F 8/14; D04H 3/12

[58] Field of Search ..... 264/171, 176 F, 210 F; 428/340, 373, 370, 401, 288, 290, 425; 427/390, 336, 353, 307; 28/72.2 R, 75 R, 76 T

[56] References Cited

UNITED STATES PATENTS

| | | | |
|---|---|---|---|
| 3,716,614 | 2/1973 | Okamota et al. | 428/370 |
| 3,718,534 | 2/1973 | Okamota et al. | 428/373 |

FOREIGN PATENTS OR APPLICATIONS

| | | | |
|---|---|---|---|
| 1,218,191 | 1/1971 | United Kingdom | 428/373 |
| 1,263,221 | 2/1972 | United Kingdom | 428/373 |

*Primary Examiner*—J.C. Cannon

[57] ABSTRACT

A multi-component thermoplastic fiber comprising a specified component of a copolymer of the vinyl series, and having very excellent drawability at a low temperature and excellent dimensional stability and a method of obtaining said product.

11 Claims, 9 Drawing Figures

(A)----PELLETIZING AT 245°C (B)----PELLETIZING AT 210°C (C)----1,3,5-TRIMETHYL-246-TRIS(3,5-DI-TER-BUTYL-4-HYDROXBENZYL)BENZEN (1 PART ADDING)

MULTI-COMPONENT FIBER, THE METHOD FOR MAKING SAID AND POLYURETHANE MATRIX SHEETS FORMED FROM SAID

This is a continuation of application Ser. No. 457,542, filed Apr. 3, 1974, and now abandoned.

BACKGROUND OF THE INVENTION

A multi-component fiber is a fiber consisting of at least two components; various types are known. Specifically these include the sheath-core type composite fiber as shown, for example, in U.S. Pat. No. 2,989,798 and British patent No. 514,638, the so-called side-by-side type composite fiber as shown in U.S. Pat. Nos. 2,428,046, 3,038,239 and 3,117,906, the so-called kidney type composite fiber as shown in U.S. Pat. Nos. 2,987,797 and 3,035,235 the "islands-in-a-sea" type composite fiber as shown in British patent No. 1,171,843, the composite fibers having irregularly shaped cores as shown in U.S. Pat. Nos. 3,350,488 and 2,932,079 and 3,672,802 and in French patent No. 1,495,835 and polymer blend type fibers as shown in U.S. Pat. No. 3,099,067, for example. Further, as a special example, a polymer blend may be used as a component of an islands-in-a-sea type composite fiber.

Of these multi-component fibers, typical examples of cross-sections of islands-in-a-sea type composite fibers are shown in FIGS. 1 (*a*) and 1 (*b*). FIG. 1 (*a*) is an example of an islands-in-a-sea type composite fiber having 16 islands, whereas the fiber of FIG. 1 (*b*) has 36 islands. In both, some islands are surrounded by other islands. When the number of islands in the fiber is increased, this increases the ratio of islands to the sea, and the stability of the fiber increases.

These multi-component fibers have many uses per se. However, by removing at least one component from such a fiber, a unique usage is opened up, as in the case of, for example, British patent No. 1,218,191. For example, a component may be removed by dissolution of a conventional multi-component fiber, but this presents problems.

The following characteristics are often required of a component to be removed by dissolution:

1. Good spinnability; it is intended to be spun together with one or more other components; it must be stably spinnable at the existing spinning temperature.
2. It must not react with other components during spinning (especially, it must not gel by any cross-linking reaction).
3. It must be drawable (it must not fuse during drawing).,
4. It must have flexibility to some extent (which is especially necessary when it is to be crimped).
5. It must be readily soluble.
6. It must be low in cost.

The following are examples of conventional components to be removed by dissolution:

A. Examples of components having good spinnability, drawability and flexibility while sacrificing solubility:

Polyamides, polyesters and polyacrylonitriles are excellent in respect of spinnability, but are difficult to remove by dissolution, as has been observed in U.S. Pat. Nos. 3,350,488 and 3,382,305 and in French patent No. 1,495,835.

In case (A), with respect to the solvent, there are problems such as dissolving speed and difficult handling. For example, when dissolving polyamide in formic acid, the material of the container and the design of the machine for handling formic acid present industrial problems. Almost no materials satisfactorily reist corrosion by formic acid except titanium alloys, especially when heating is used for increasing solubility. Especially when removal of formic acid from the product after dissolution, and recovery of formic acid are taken into account, the use of formic acid on an industrial scale is very troublesome.

In the use of ortho-chlorophenol as a solvent for polyester also, danger of using the solvent is great and its dissolving speed is too slow. In the case of acrylonitrile, there is only a limited selection of polymers which can be simultaneously spun with acrylonitrile. Also great difficulty is encountered in its removal by dissolution.

B. Examples of components having good solubility while sacrificing spinnability;

Some polymers are inferior in drawability and flexibility, such as polystyrene, polystyrene-acrylonitrile copolymers and polystyrene-methyl methacrylate copolymers, as reported in British patent No. 1,263,221 and in U.S. Pat. No. 2,930,074.

In case (B), solvent which is low in cost and easy to handle, such as a hydrocarbon of the aromatic series or a hydrocarbon of the chlorine series may be selected as a solvent.

However, when such a polymer is used, especially when such a polymer occupies at least 40% of the surfaces of the multi-component fiber, the drawability and flexibility of the fiber become very poor. The following explanation will elaborate.

Drawbacks in the use of polymers of the polystyrene series:

Polystyrene per se is a very brittle polymer; the elongation of undrawn polystyrene yarn at room temperature is at most 6 – 10%. Because it is brittle, polystyrene alone is very difficult to draw. By using polystyrene as one component of multi-component fiber, the polystyrene is reinforced by other components and becomes somewhat easier to handle. However, the other components become weaker because of the presence of the polystyrene, which is most difficult to draw. Especially when polystyrene is present over at least 40% of the surface of the multi-component fiber, the fiber becomes most difficult to draw. When the temperature is raised so that the polystyrene can be drawn, the polystyrene becomes tacky and the multi-component fibers stick to one another.

In a multi-component fiber, when polystyrene occupies at least 40% of the fiber surface, it is very difficult to draw the fiber. Polystyrene begins to flow at a temperature of 105° – 115° C. As soon as the polystyrene begins to flow, the multi-component fiber becomes tacky, the fiber fuses on the surface of the heat source (hot plate) or the fibers fuse among themselves. Also, the fiber can be drawn only within a very limited range and for a very short period of time. It may be stated, accordingly, that such fibers cannot be drawn sufficiently, in the industrial sense. Elongation at a lower temperature does not give sufficient results; for example, by drawing with steam heat as is ordinarily carried out industrially in staple drawing, the multi-component fibers can be drawn only to 2.0 – 2.5 times its initial length. When drawn more, the polystyrene on the surface whitens, cracks and breaks, and the resulting fiber cannot withstand actual use.

Specifically, since it is impossible sufficiently to draw such a multi-component fiber under normal industrial conditions, this makes it necessary to make a fine denier undrawn yarn, in which case spinning productively suffers.

Because a complicated spinneret is usually used to obtain a multi-component fiber, it is difficult to effectively increase the number of nozzles on the spinneret. Accordingly, spinning productivity cannot be increased which is a fatal drawback with respect to the cost of the fiber as a product.

Further, the physical properties of the multi-component fiber product also deteriorate. Because the fiber is not to be drawn to the desired extent, its elongation is quite high and its Young's modulus is low. The characteristics of the fiber are close to those of undrawn yarn. Such poor drawability and brittleness of polystyrene are particularly troublesome when a highly shrinkable fiber is desired.

In order to obtain a highly contractible fiber, the fiber must be drawn at as low a temperature as possible so as to impart an internal strain to the fiber. When polystyrene is used as the sea component in an islands-in-a-sea type composite fiber, such fiber cannot be drawn at as low a temperature as 60° – 70° C; at 98% C or higher drawability begins to some extent, but the resulting fiber does not have a sufficient (e.g. more than 25%) shrinkage.

And in the case of a contractible fiber, two-stage contractibility is important. When the fiber has been once contracted at a relatively low temperature, and is thereafter contracted at a higher temperature, the fiber should still show contractibility. The most ideal relationship in two-stage contractibility is that the sum of the first stage shrinkage and the second stage shrinkage equals the shrinkage that would be obtained if the fiber were suddenly exposed to the higher temperature.

When the fiber is drawn at a high temperature, it is difficult to obtain a fiber having excellent two-stage contractibility. When polystyrene is used, the temperature at which the drawn yarn begins to contract is relatively high, due partly to the limiting condition that polystyrene must be drawn at a high temperature. It is difficult to carry out stepwise slow contraction on the low temperature side, it is not possible to provide a wide range of contracting temperature upon carrying out two-stage contraction, and two-stage contraction is accordingly difficult.

As a means for solving the aforementioned problems of drawability and contractibility when polystyrene is used, it is conceivable to add a plasticizer to the polystyrene. However, no anticipated substantial effect is obtained. Further problems arise when a plasticizer is used, including mixing and affinity of the plasticizer with the polymer, bleed-out and evaporation of the plasticizer.

In general, plasticizing of a polymer with a plasticizer requires a large amount of the plasticizer. When a large amount of plasticizer is added to the polymer, it is technically difficult to mix the two uniformly, and even if they are mixed, the plasticizer bleeds out and evaporates through the fiber surface during melt spinning of the polymer. The amount of plasticizer remaining in the polymer fiber is sharply reduced and a substantial plasticizing effect cannot be realized.

Further, when such a large amount of the plasticizer is added to the polymer, the melt viscosity of the polymer becomes drastically lower. In the spinning of multi-component fibers, the maintenance of a balance of melt viscosity values among respective components is very important for the stabilization of spinning. Poor balance results in composite unevenness and abnormal variations of cross-section and bending of the fiber just under the spinneret.

Further, crystallization of other polymers is sometimes caused by the plasticizer. When crystallization proceeds in an undrawn yarn, the fiber becomes difficult to draw. Depending upon the particular plasticizer, such crystallization may even be accelerated.

Also, with reference to a problem of evaporation of the plasticizer at the time of spinning, the plasticizer tends to evaporate through the surface of a yarn having a large surface area and the plasticizer tends to form bubbles, which tend to cause breakage of the yarn.

As mentioned above, improvement of drawability by adding a plasticizer can hardly be expected. Accordingly, it is an object of great desirability to develop a novel polymer. Such a novel polymer should be easy to draw at a relatively low temperature, and should not fuse within at least a certain range of temperature within which other components are drawn. In the case of polystyrene, it fuses simultaneously under normal drawing conditions. In the case of polystyrene-acrylonitrile copolymers and polystyrene-methyl methacrylate copolymers, they also present the same problems associated with polystyrene and they do not show any improvement of drawability of flexibility.

SUMMARY OF THE INVENTION

The present invention relates to a multi-component fiber which is drawable without fusing at a low temperature (of not more than about 85° C), which has excellent spinning stability, and one component of which is easily removable by dissolution with a solvent. Another object of the present invention is to provide a multi-component, highly contractible fiber composed of this novel polymer, and to a method of making such fiber.

It is an object of the present invention to provide an excellent fiber having excellent drawability under industrial conditions and being free from cracks.

Still another object of the present invention is to provide a fiber having excellent performance in carding, which does not tend to nep, and which does tend to intertwine or ligate by needle punching. Still another object of the present invention is to provide a matted or felted product having excellent characteristics using such fiber, and further relates to a method of making such a product.

According to the present invention, the polymer consists mainly of a copolymer of styrene and an acrylic vinyl compound having an HDT (heat deformation temperature measured by British standard method No. 2782) of 40° – 75° C, an elongation in hot water at 70° C of at least 100% and a shrinkage in hot water at 85° C of at least 15%; the fiber of the present invention is a multi-component fiber using such polymer as one component.

Fibers according to the present invention are obtained by drawing, at a draw ratio of at least 2.6, a multi-component undrawn yarn, containing said polymer of the present invention as one component, at about 50° – 100° C. It is preferable to carry out crimping of such fiber at a temperature below about 60° C and drying of said fiber at a temperature below about 60° C.

This invention also relates to the fiber product obtained by contracting such fiber and heat treating the contracted fiber at at temperature ranging from about 100° C to 220° C, before or after removing one component, and to a method of making such a fiber product.

DRAWINGS

FIGS. 1 (*a*) and 1 (*b*) are cross-sectional views of islands-in-a-sea type composite fibers.

DESCRIPTION OF THE PREFERRED EMBODIMENT

The present invention relates to a multi-component fiber having excellent drawability at a low temperature, which comprises a specified component of a copolymer of the vinyl series.

From our knowledge of the serious drawbacks associated with conventional polystyrene-acrylonitrile copolymers and polystyrene-methyl methacrylate copolymers, the possibility of improving the properties of the fiber by copolymerization of the polystyrene has heretofore seemed to us to be very remote indeed. Actually, we seriously considered abandoning the possibility of improving the properties by this copolymerization procedure, after studying the results of the following examinations.

1. Copolymerization of polyvinyl ether and styrene:

Polyvinyl ether has been known as a plasticizer of polystyrene. Accordingly, it was anticipated that remarkable flexibility would be imparted by copolymerization of the two. Methyl-, ethyl-, and butyl-vinyl ethers were selected in trying copolymerization with styrene. However, the product was a waxy brittle copolymer having inferior performance as compared with the homopolymer of polystyrene.

2. Copolymerization of acrylic acid ester and styrene:

Methyl acrylate and ethyl acrylate were selected in carrying out the examination. When each copolymer was simultaneously spun with polyethylene terephthalate as a multi-component fiber, a gel was formed which blocked the spinneret. When the spinneret pack was dismantled, the gel was found to be insoluble in solvents; the spinneret was blocked and became useless. When butyl acrylate was used as the acrylic acid ester, the same result was obtained.

Accordingly, polymers of the vinyl series present serious problems in terms of performance and spinning, and cannot be used. It appeared that our study was deadlocked at this point. However, we have now discovered a surprising fact.

We have discovered that, among the polymers of the vinyl series, a particular polymer is thermally stable, surprisingly yielding a copolymer which does not gel, and which possesses excellent drawability at a low temperature, and which combines admirably with other polymers simultaneously spun.

Although gelation occurs especially often with combinations of polyesters with esters of the vinyl series, such gelation can be avoided when the vinyl polymer is the very particular polymer according to this invention, which is a copolymer of the vinyl series having an HDT (heat deformation temperature measured by British standard method No. 2782) of 75° – 40° C, an elongation in hot water at 70° C of at least 100% and a shrinkage in hot water at 85° C of at least 15%.

The most simple example of such polymer is a styrene-acrylic acid ester copolymer of the vinyl series containing about 10 – 30% by weight of acrylic acid ester unit and about 90 – 70% by weight of the styrene unit.

Figure 2:
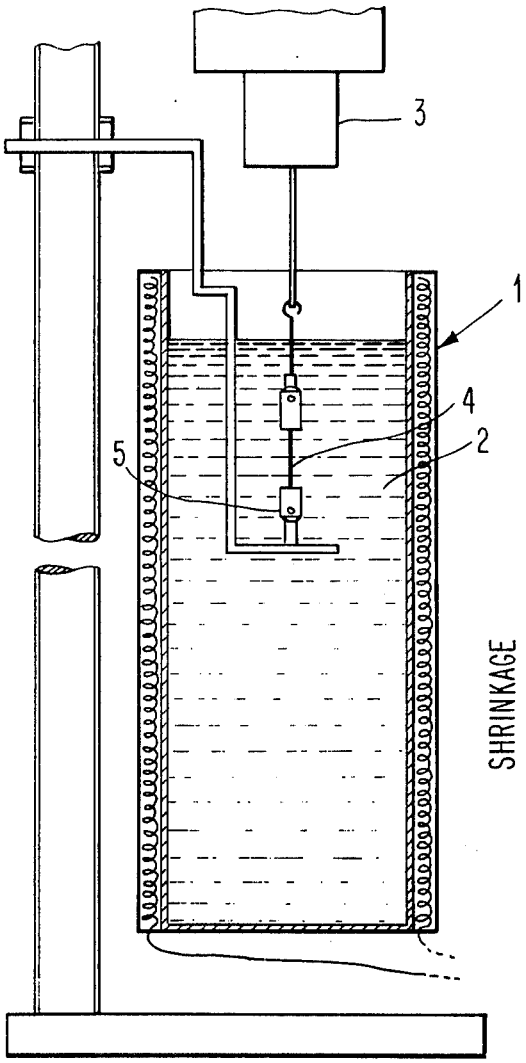
FIG. 2 is a view in side section, showing an apparatus used for measuring the elongation of a polymer according to the present invention.

In referring to elongation in hot water at 70° C, this is measured in the following manner:

A cylinder having an internal diameter of 10 mm is precisely heated to 220° C. At the lower end of this cylinder an orifice having a length of 8 mm and a diameter of 1 mm is provided. The polymer is placed inside the cylinder and allowed to stand there for two minutes. The polymer is then extruded through the orifice from above the cylinder while the load is adjusted to provide a flow rate of 0.3 g/min. Ten undrawn yarns, produced in this manner, are bundled and subjected to a tensile test based on ordinary strain-stress measuring techniques, using the apparatus shown in FIG. 2. Elongation at break is the elongation of the polymer at a water temperature of 70° C, using a sample length of 1 cm and a tensile speed of 1 cm/min.

In accordance with the method of measuring shrinkage, 40 undrawn yarns extruded as just referred to are bundled. A fiber bundle 20 cm long is immersed in hot water at 85° C, taken out after 3 minutes and the length of the fiber bundle is measured and reported as L centimeters. The shrinkage is $$\text{Shrinkage} = \frac{20 - L}{20} \times 100\ (\%)$$

According to this invention, the HDT of the copolymer according to this invention must be not more than about 75° C, which is necessary, upon imparting crimp to a multi-component fiber comprising the copolymer, for preventing said fiber from cracking or splitting and for increasing the flexibility of the fiber as well. However, when the HDT is too low, various difficulties are brought about. The fibers become apt to fuse and stick to one another at drawing. When subjected only to slight friction, or to heat generated in carding, the fiber fuses. Accordingly, it is necessary that the HDT be not less than about 40° C.

Elongation in hot water at 70° C is important. The elongation reflects the degree of polymerization and linearity of the molecule, becoming a criterion of spinnability and of drawability. In order that a multi-component fiber may show good drawability at a low temperature, it is necessary that the value of this elongation should be at least about 100%.

As regards contractibility, it is necessary that the shrinkage be at least about 15% at 85° C. The degree of contractibility becomes especially important when a highly contractible fiber is to be obtained. Contracting stress is not always necessary. It is sufficient for the component to properly follow and not to obstruct the contraction of the other component.

It is important to provide a particular polymer which is a copolymer consisting mainly of a reaction product of styrene and an ester of the vinyl series, containing 90 – 60% as a whole of the styrene unit, and 10 – 30%, preferably 15 – 20% of the vinyl type ester unit. The foregoing are main components; if desired another vinyl monomer may be further copolymerized if necessary for adjusting the viscosity and improving the heat stability of the product.

Esters of the vinyl series include the acrylate esters and methacrylate esters, when such an ester is simultaneously spun with a polyester, an ester having 6 – 20 carbon atoms preferably 8 – 18 is preferred. Such an ester, being a reaction product of acrylic acid or methacrylic acid to form an ester with an alcohol having a boiling point of at least 150° C (at 760 mm Hg), which is effective to prevent gelation.

In this invention, the configuration of such alcohol is also important. Such alcohol has a side chain which is preferable from the viewpoint of the drawability. However, when the heat resistance of the polymer is critical, an alcohol which has a straight chain is preferable. The selection of a particular straight-chain or side-chain alcohol should be judged according to the situation at that time; sometimes it is preferred to use them in admixture.

As specific examples of esters of the vinyl series which may be used in the present invention, they may be classified into those having an ester group which contains less than 6 carbon atoms such as methyl acrylate, butyl acrylate, methyl methacrylate and butyl methacrylate and those whose ester group contains at least 6 carbon atoms such as hexyl acrylate, n-octyl acrylate, 2-ethyl hexyl acrylate, tri-methyl heptyl acrylate, stearyl acrylate, lauryl acrylate, hexyl methacrylate, n-octyl methacrylate, 2-ethylhexyl methacrylate, tri-methylheptyl methacrylate, stearyl methacrylate and lauryl methacrylate.

When the ester group contains less than 6 carbon atoms, gelation occurs upon simultaneous spinning with polyester, and spinning becomes impossible. Accordingly, such esters are limited to combinations with polymers other than polyester. When the ester group contains at least 6 carbon atoms, gelation does not occur, and spinning may be carried out favorably. However, when the number of carbon atoms is too great, drawability becomes inferior. Accordingly, it is preferred that the number of carbon atoms be not more than about 20, preferably not more than about 18.

Especially preferable examples of esters of the vinyl series in the present invention are those which contain an alkyl group having at least 6 carbon atoms, having a side chain, namely, 2-ethylhexyl acrylate and 3,5,5-trimethylheptyl acrylate.

Regarding the copolymerization ratio, 10 – 30%, preferably 15 – 25% of such ester of the vinyl series is preferred. Different from the situation in which a plasticizer is added, the effect begins to appear at about 10% and comes out sharply at about 15%. However, more than 30% is not preferred, because there is too much plasticization, spinning becomes difficult due to fusion of chips or pellets and there is too great a difference of melt viscosity values between the composite components at the time of melting. Fusion of fiber and fiber characteristics at the time of drawing are greatly influenced by slight fluctuations of temperature.

The polymer according to this invention is ready to react and polymerizable under conditions of ordinary polymerization of styrene, or somewhat modified conditions. Industrially, radial polymerization is preferable. Appropriate polymerization initiators include benzoyl peroxide and terbutyl-per-benzoic acid.

However, drawability is somewhat influenced by the added amount of polymerization initiator. When the added amount is too great, the degree of polymerization does not increase, which is not desirable. When the added amount is too small, the polymerization rate is too slow. Characteristically, it is preferred to set up a criterion such that the intrinsic viscosity measured at 30° C in toluene is about 0.6 – 1.2.

The present invention relates to a multi-component fiber in which the polymer just described is one component. The component of the present invention is effective when it is intended to be removed by dissolution, especially when it occupies at least 40% of the fiber surface in the multi-component fiber.

In general, when the fiber surface occupying ratio of a component that fuses at the time of drawing is as high as 40% or more, difficulties at the time of drawing, such as sticking of the fibers, and depositing residues on the heater plate at the time of drawing, become very serious. However, when the polymer of the present invention is used, such troubles do not occur. This is an outstanding feature of this invention.

The most preferable configuration of a fiber in the combination of the present invention is a fiber whose surface is completely surrounded by a component to be removed by dissolution. Specifically, these configurations include the islands-in-a-sea type composite fibers, sheath-core type composite fibers, composite fibers with irregular shaped cores, and polymer blend type fibers at least 60 of the surface of which are surrounded by a component which is to be removed by dissolution.

Some of the important characteristics of the present invention consist in imparting softness and flexibility to a fiber using a low softening point copolymer; it has been discovered that even if such low softening point component is used, the fiber can be drawn without fusion. Specifically, a polymer in an unoriented molecular state, such as a pellet, tends to fuse easily. However, a polymer in the drawn and oriented state is unlikely to fuse. The discovery that fusion in an amorphous polymer is prevented by orientation of large chain-molecules is a characteristic feature of the present invention.

As other polymers used in combination with the polymer of the present invention, in such fiber, mention should be made of polyamides and copolyamides such as poly-ε-capramide and polyhexamethylene adipamide; polyesters and copolyesters such as polyethylene terephthalate, polybutylene terephthalate, polyoxy benzoate, polyethylene terephthalate-polybutylene-isophthalate copolymers, and polyolefins such as polyethylene and polypropylene.

Of these polymers, polyesters, having a softening point, as defined hereinbelow, of not more than 250° C are especially preferable in regard to preferred balance of drawability with the polymer of the present invention.

The softening point referred to herein is defined as a temperature measured by a differential scanning calorimeter DSC-II manufactured by Perkin-Elmer Co. at a rate of temperature increase of 10° C/min, a sensitivity of 5 cal/sec and a sample amount of 10 mg corresponding to the starting point of a fiber melting peak. Said starting is an intersecting point of the base line of said peak and a tangent drawn at a point at the intermediate height of said peak.

Such polyesters include polyethylene terephthalate-polyethylene isophthalate copolymers, polyethylene terephthalate-adipic acid copolymers, polyethylene glycol, polyethylene terephthalate and polyethylene isophthalate.

The weight ratio of the polymer of the present invention to the other polymer in the spinning of a multi-component is preferably within the range of about 65/35 14 35/65.

Upon spinning a multi-component fiber using a copolymerization component according to the present invention, the heat career of the copolymer prior to spinning becomes very important; it has a remarkable influence upon the thermal decomposition of the polymer at the time of spinning. Especially when the copolymer is exposed to a high temperature of at least 240° C before spinning (when the copolymer is pelletized at 240° C), the thermal decomposition of the polymer at the time of spinning becomes remarkable. Accordingly, it is necessary not to overheat the polymer prior to spinning. The polymer is likely to fuse and block at a supplying zone of extruding machine. So it is useful to strengthen the cooling of a supplying zone to prevent blocking at the supply opening due to fusion of a bead polymer. In order to prevent such difficulties, it is possible to extrude the polymer, after completion of polymerization, directly into pellets by block polymerization.

In order to prevent thermal decomposition of the polymer, it is also effective to add a thermal decomposition inhibitor. Stabilizers of the phenol series are excellent, for example, 2,6-di-ter-butyl-α-dimethyl amino p-cresol; 2,2'-methylene-bis-(4-methyl-6-tert-butylphenol); 1,3,5-trimethyl-2,4,6-tris (3,5-di-ter-butyl-4-hydroxybenzyl) benzene; 4,4'-thiobis-(6-ter-butyl-3-methylphenol) and 2,2'-dihydroxy-3,3'-di (α-methylcyclohexyl)-5,5'-dimethyl-diphenyl methane.

In the spinning of a multi-component fiber using a component of the present invention, the temperature of the atmosphere below the spinneret is very important. The drawability of the resulting fiber is greatly influenced by atmospheric conditions up to 30 cm below the spinneret. A temperature range of about 130° – 320° C is recommended at a point 10 cm directly below the spinneret. Especially, upon simultaneously spinning a very low softening point polymer with a high softening point polymer of a composite fiber, by making such ambient temperature higher than the softening point of the low softening point polymer, but lower than the softening point of the high softening point polymer, it is possible to promote molecular orientation of the high softening point polymer only, and to avoid molecular orientation of the low softening point polymer. When the drawability of the low softening point polymer is poor as compared to that of the high softening point polymer, as in the present invention, such method is very effective for imparting drawability to a multi-component fiber.

It is preferable not to cool the fiber of the present invention suddenly. Accordingly, upon winding the fiber, it is preferable to control the temperature of the fiber to a value somewhat higher, and to heat the fiber as occasion demands, and to wind the fiber at about 20°–60° C.

The influence exerted upon the fibers by oiling agents ("spin finishes") is also important. The copolymer of the present invention cracks under the influence of certain kinds of oiling agents. It is recommended to avoid oiling agents containing lower alcohols. Selection of an oiling agent used for the fibers of the present invention is carried out using a tensile tester shown in FIG. 2, by pulling an undrawn yarn at 50° C in a 3% solution of the oiling agent to be checked. The oiling agent in a solution of which, fluctuation of tensile strength of the undrawn yarn at the point elongated by 100% is more than 0.2 g/denier, is not preferable.

Upon spinning, the polymer is usually supplied as pellets to the spinning machine. Upon supplying such pellets it is necessary to control them sufficiently so that their temperature does not become too high. Otherwise the pellet fuses, becomes a block and becomes impossible to supply. Heat from a melting zone is transmitted to a polymer supply zone and the polymer is heated more than expected. In order to prevent such difficulty, it is effective to cool the pellet from without to keep the pellet at a temperature lower than the fusion temperature until the polymer reaches the melting zone.

Polymers of the present invention may be melted at about 220°–290° C. However, it is preferable to melt the polymer at lower temperature from the viewpoint of melt viscosity and for preventing thermal decomposition.

A fiber according to the present invention may be taken up without any problem under ordinary conditions. However, the advantageous characteristics of the styrene-vinyl ester fiber of the present invention are best developed when the spun fiber is taken up at a rate of at least about 1500 m/min. At this time, it is effective to keep the spinning temperature low. Inside the spinneret, the styrene-vinyl ester polymer of the present invention is sufficiently fluid, having a function like a lubricant and smoothing the discharge of the other fiber-forming component. Because of this advantageous characteristic, it is possible to operate effectively with a relatively low spinning temperature.

Such means is especially effective in the case of a fiber having a plurality of independent islands in one fiber, such as islands-in-a-sea type composite fiber. By taking up the fiber at a high speed, the orientation of the fiber is promoted and the subsequent drawing step can be dramatically shortened. When one component is dispersed thinly in another component, the orientation at the time of take-up tends to proceed to a greater degree than when one component collects thickly. This inclination is especially remarkable when a polymer having a low softening point and low elongation at room temperature is used as in the present invention.

Such a fiber is especially effective when it is taken up in the form of a sheet, using an air jet.

Upon drawing the fiber, it is desirable to establish the drawing temperature at about 50°–100° C. The significance of the fact that the fiber can be drawn at a temperature not higher than 100° C is very great, because drawing by steam heating at atmospheric pressure, as usually carried out in ordinary staple drawing, becomes practical. Also, drawing in hot water is practical and effective.

As in the past, a yarn using polystyrene cannot be drawn satisfactorily at a high draw ratio (more than 2.5 times) at a temperature not more than 100° C. When the yarn is drawn at a low temperature the polystyrene cracks, the fiber surface becomes rough and fibrillation and breakage of the fiber tend to occur. In order sufficiently to draw polystyrene, it is necessary to heat the same at a temperature above 100° C, actually at least 120° C. In order to do this a hot plate or hot roll is used. However, in the case of polystyrene, when it becomes easy to draw, it also becomes easy to fuse and tacky at the same time.

When polystyrene is drawn in such state, it fuses and sticks to the hot plate or fuses by reason of friction between the hot plate and the polymer. Accordingly, it is very difficult sufficiently to draw polystyrene on an industrial scale.

In accordance with the present invention, the fiber can be drawn at a temperature not higher than 100° C and, during the drawing step, the fiber does not stick to the heater.

Figure 6:
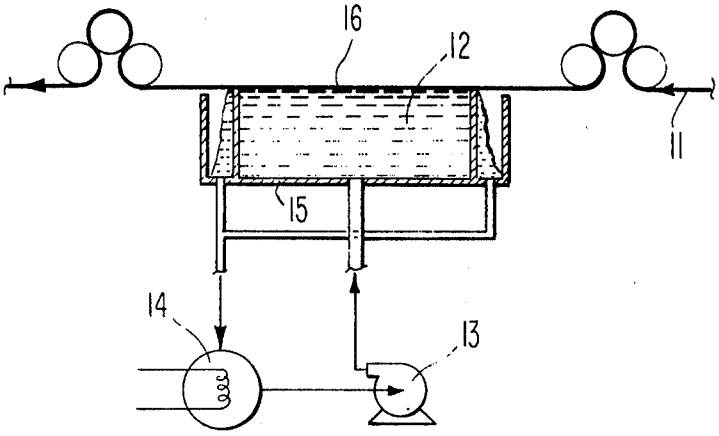
FIG. 6 is a view in side elevation showing one example of a liquid-bath drawing apparatus preferably used for drawing a fiber according to the present invention.

Drawing according to the present invention may be carried out by steam heating at atmospheric pressure as carried out in usual staple drawing. However, a preferable method of drawing is based upon the use of a hot liquid as the heating medium. Hot water is ordinarily used. The fiber is passed through hot water kept at a constant temperature, and drawn. However, a still more preferable method of drawing is the method shown in FIG. 6. In FIG. 6, 11 is a fiber to be drawn and 12 is a liquid kept at a constant temperature and supplied from a tank 14 by a pump 13. This liquid overflows from a draw box 15 and refluxes to 14. 16 is the swollen liquid surface of the overflowing liquid on or in which the fiber passes to be drawn.

Drawing in an overflowing liquid is especially preferable in that the fiber does not contact any solid substance in the draw zone. Abrasion of the fiber surface is prevented and fiber damage is minimized.

Hot water suffices as the liquid used. However, addition of fiber treating agents such as oiling agents, (spin finish) and antistatic agents to the hot water gives especially good results because such agents adhere uniformly to the fiber when applied in this manner during the drawing stage.

In the present invention the fiber may be drawn on a hot plate as well. In the present invention formation of deposits upon the hot plate, as seen in the case of drawing polystyrene, is not brought about.

Upon carrying out drawing according to the present invention, drawability is sometimes improved remarkably by carrying out preliminary heating before drawing. 30°–80° C is appropriate as the preliminary heating temperature. At the time of carrying out preliminary heating, the fiber may either be relaxed or under tension.

The present invention is especially effective in making a multi-component fiber, especially a highly contractible multi-component fiber containing polyester. The highly contractible fiber referred to herein is a fiber showing shrinkage of at least 15% to the initial length of 20 cm when it is immersed in hot water at 90 °C with a load of 5 mg/denier at one end of the sample.

In order to make a highly contractible fiber containing polyester, two methods are available, as follows:

A. Lowering the draw ratio and utilizing a zone in which the molecular orientation is extremely poor.

This is a very effective method when only shrinkage is considered and the practical characteristics of tensile strength and elongation are ignored. However, a fiber obtained by this method is essentially a so-called undrawn yarn. Upon actually using such a fiber, it undesirably elongates even under small tension, and its tensile strength is low. When such a fiber is further contracted, its physical properties become even worse.

Accordingly, a fiber having much better characteristics of molecular orientation is required. For obtaining such fiber the method is:

B. Carrying out drawing at a high draw ratio at a low temperature:

Drawing at a low temperature causes strain in the fiber. It is necessary to carry out drawing at a temperature not above 100° C as usually carried out industrially. In conventional polystyrene-polyester systems, it has not been possible to draw at a ratio of at least 2.5 times under this drawing condition.

In accordance with the present invention, the fiber is drawn sufficiently at such a low temperature, and a highly contractible fiber having excellent molecular orientation and excellent tensile strength and elongation is obtained.

The draw temperature and draw ratio are important. It is preferable that the draw temperature be about 50°–100° C, preferably about 60°–85° C and that the draw ratio be about 2.6–4.80, preferably 3.0–4.3. At a temperature below 50° C, drawing of polyester becomes impossible. At a temperature above 100° C, the internal strain necessary for contraction is not formed in the fiber. It is necessary that the draw ratio be at least about 2.6. For sufficient tensile strength and elongation, it is necessary to use a higher draw ratio. The higher the draw ratio, the more preferable. However, from the industrial viewpoint, an appropriate upper limit is about 4.8.

Crimping conditions are also important. In the crimping operation, the crimper is heated by the friction of the fibers. Partial contraction of the fiber is caused by this heat, reducing the shrinkage of the fiber. Accordingly, it is necessary to repress the heat as much as possible. Specifically, it is necessary to keep the temperature of the crimper below 70° C, preferably below 50° C. It is desirable to cool the crimper by an oiling agent applied to the fiber.

It is an advantage of the present invention that the crimp may be imparted at a low temperature. In a system using polystyrene as in the past, because polystyrene is hard and brittle, it has not been possible to produce enough crimp at a low temperature, and serious abrasion of the crimper has been experienced. Accordingly, it has been necessary to preheat the fiber and to crimp at a high temperature. Accordingly, even if a highly contractible fiber is obtained by drawing, it loses its contractibility by reason of the crimping step. However, fibers of the present invention are free from such difficulties.

Upon obtaining a highly contractible multi-component fiber, the conditions used in drying the crimped fibers are also important. Heretofore, a relatively high drying temperature has been used for heat setting the crimp of the fibers, and for efficiency of drying. High temperatures were necessary to obtain sufficient setting of crimp. However, in a system in which the polymer of this invention is present, the heat setting properties at low temperatures are very good. Accordingly, it is possible to use a low crimp heat setting temperature. When drying is carried out at a high temperature, partial contraction occurs, shrinkage is reduced and the resulting two-stage contractibility of the fibers is inferior. Accordingly, a temperature as low as possible, such as below 60° C, preferably below 40° C, should be used.

Upon contracting the fiber, its two-stage contractibility is also an important factor. In determining two-stage contraction a fiber placed under a load of 5 mg/denier is immersed in hot water at 60° C for 1 minute to contract the fiber, and the fiber is then immersed in hot water at 90° C for 3 minutes to contract the fiber further. The ratio of total shrinkage at the end of that time to the initial length of the fiber, to shrinkage obtained when the same fiber is immersed in hot water at 90° C for 4 minutes in one stage, is called the two-stage contraction of the fiber. It is preferable that the shrinkage in two-stage contraction should be at least 60% of the shrinkage in a single contraction, preferably at least 70%. Two-stage contractibility is especially important when the fiber is contracted as a sheet.

When a sheet is contracted in one stage, creases are formed, the surface becomes uneven and the commercial value of the product is sharply reduced. In order to carry out uniform contraction, it should occur gradually (stepwise) and slowly. To such two-stage contractibility, the polymer of the present invention contributes to contraction at a low temperature at the first stage due to its low heat deformation temperature, showing sufficient plasticization and not obstructing the contraction of any other polymer during the second stage contraction at a high temperature. This gives very good results in two-stage contractibility.

Upon this two-stage contractibility, the draw ratio, temperature during crimping and drying temperature and drawing temperature exert a large influence. The two-stage contractibility of the fiber is advantageous only under the aforementioned conditions.

For providing a highly contractible multi-component fiber according to the present invention, the combination of a polymer of the vinyl series with a polyester is preferable; the fiber is highly contractible and is unlikely to elongate even after contraction.

In general, when a fiber is contracted, it tends to elongate corresponding to the amount of shrinkage, resulting in permanent deformation. The use of such fiber results in processing difficulty and deformation of the product. Upon using a highly contractible fiber, mutally contradictory characteristics are required: that the fiber should contract sufficiently and that the fiber should not tend to elongate after contraction. The present invention has resolved this contradiction admirably.

By way of summary, the first requirement is to draw the fiber at a low temperature to increase its shrinkage. Another requirement is to draw the fiber at a draw ratio of at least 2.6, preferably at least 3.0. Still another requirement is to heat treat the contracted fiber at a temperature ranging from about 160° C to 220° C. When these three requirements are combined, a highly contractible multi-component fiber having good physical properties may be obtained for the first time.

By heat treatment at a temperature not less than about 160° C, the fiber becomes hard and does not have a tendency easily to elongate. However, upon carrying out the heat treatment, the fiber should be drawn to adequate extent — otherwise voluntary elongation of the contracted fiber along with the polyester occurs and the resulting shrinkage of the contracted fiber are diminished by the voluntary elongation of the fiber. When the draw temperature of the fiber is low, this voluntary elongation tends to occur. In order to repress it, it is necessary to make the draw ratio high.

Heretofore there has been no polymer having excellent solubility and drawability at a low temperature, as in the present invention. Therefore, the conditions mentioned above had not been available for use.

Fibers according to the present invention are effective and advantageous when applied to knitted fabrics, woven fabrics and non-woven fabrics. Because to being drawn to high extent the fiber characteristics are excellent and the characteristics of the product are greatly improved as compared to conventional products. The component to be removed by dissolution of the fiber of the present invention is removed as in a fiber or fabric.

A highly contractible fiber is especially effective for obtaining crepe and non-woven fabrics having compact structures, and these fibers are especially advantageous for products having a nap. The fiber of the present invention exhibits excellent characteristics in carding. In conventional fibers of the polystyrene series, the polystyrene tends to split, the fiber tends to become fibrillated at the time of spinning, neps (lamps) are formed and the fiber coils around the roll of the carding machine frequently causing trouble. However, the fiber of the present invention is remarkably free from such trouble. As a spun yarn it is excellent, and the product has only a very fluff (the hairs of the surface of the spun yarn).

Further, fibers of the present invention may be applied most advantageously to the manufacture of synthetic leather-like sheet materials. When a multi-component fiber using polystyrene has been used for making such sheet materials, as in the past, carding has been poor and fiber intertwinement upon needle punching has been poor because the polystyrene tends to split, lacks flexibility and has only a limited capability to produce fiber intertwinement. Also, the fiber has not been sufficiently drawn, and the product has had a tendency to elongate and to undergo deformation. When the nap was formed on the surface of sheet product of such fibers, the nap has tended to become entangled and to be lacking in gloss.

Such leather-like material has been found also to be lacking in the excellent hand, volume, compact nap and abrasion resistance possessed by natural leather. In order to obtain these characteristics, a high-density intertwined aggregation of fibers is required and the fibers constituting such intertwined aggregation is required to be made of a material having considerable resistance to elongation.

For effecting compact fiber intertwinement, needle punching should be carried out to the maximum extent. However, according to this method, when punching is carried out beyond a certain limit, breakage of the fibers is brought about and the density of the intertwined aggregation of fibers lowers as well as the tensile strength of such aggregation.

It is not sufficient to increase the density of the aggregation by needle punching and a satisfactory result is not obtained by so doing.

Another method is contraction, in which a needle punched felt is caused to contract by heat or chemicals. The fiber intertwinement per unit volume increases according to the contracted volume of the aggregation. Accordingly, it is possible to sharply increase the density of the intertwined aggregation of fibers by increasing the volume shrinkage. This in many cases is the most effective means for increasing the amount of fibers per unit volume, and to provide optimum fiber intertwinement.

However, the main drawback of such a method is that the contracted fiber tends to elongate, and that the product tends to elongate and also to become deformed. Upon forming nap, it is necessary to be able to form nap easily, in such a way that the formed nap is unlikely to intertwine and is easy to color. A fiber which is capable of solving all of these problems is required, and is provided according to this invention.

Fiber elongation after contraction is diminished and minimized to the extent of practical use by making a felt using a highly contractible multi-component fiber drawn at a high draw ratio (not less than 2.6, preferably not less than 3.0) at a low temperature, then causing the felt to contract to for a high-density felt, removing one component of said fibers while in the form of a high-density felt, and thereafter subjecting the felt to heat treatment at a temperature ranging from about 160° C to 220° C before or after applying a binder to the fibers of the high-density felt.

In this case, it is preferable that the component to be removed should occupy at least about 60% of the surface of the multi-component fiber used. Otherwise, when the felt is caused to contract to become a high-density felt, the fibers are not likely to be able to move freely or to slide relative to each other inside the felt, and the "hand" of the felt product becomes remarkably hard. By removing one component occupying a substantial volume around the surface of the fibers in this condition, large voids are formed about and among the remaining fibers, and accordingly movability (slideability) among the remaining fibers increases and the felt product becomes remarkably soft.

A further preferable multi-component fiber is one that forms a bundle of superfine fibers or the equivalent after removing one component. By conversion to a bundle of superfine fibers, the fibers per se are further softened, and still more softening of the felt product may be achieved. When the nap is formed on the surface of the fiber, the nap becomes a soft and compact one, which is highly preferable. Such multi-component fibers include islands-in-a-sea type composite fibers, composite fibers having irregular shaped cores, and certain polymer-blend types of fibers.

Multi-component fibers, one component of which is to be removed and which occupies at least about 60% of the fiber surface are drawn at a low temperature. It is preferred that the draw temperature be not more than about 100° C, preferably about 85°–60° C, because the temperature must be low in order to increase the shrinkage. A shrinkage of at least about 15%, preferably at least about 20%, is necessary. In order to obtain a high-density felt necessary in the present invention by causing a needle punched felt to contract, shrinkage to this extent is necessary. The shrinkage may be varied within a broad range by varying the draw temperature.

The required extent of the draw ratio varies according to the desired shrinkage of the fibers. In the case the degree of contraction is high, the draw ratio must be large. The following equation must be satisfied:

$$\text{Draw ratio} > 2.5 \div 0.01 \times (\text{shrinkage of the fiber } [\%])$$

Using such fibers, a felt is formed. The fibers of the present invention may be well carded and may be made into excellent felt by needle punching because the fibers are soft and not likely to split. For making the felt compact a mere contracting means is insufficient. A good end product may not be obtained from a felt which is not characterized by intimate intertwinement of the fibers. Because the apparent density of the felt decreases upon removal of one component in a subsequent step, it is necessary to increase the apparent density of the felt by needle punching to at least about 0.12 g/cm$^3$, preferaby about 0.14–0.25 g/cm$^3$.

The resulting felt is caused to contract by heat or by chemicals. The contraction should be carried out so that the shrinkage per unit area of the felt becomes at least about 27% and the density of the felt becomes at least about 0.25 g/cm$^3$. Contraction may be carried out in one stage, but it is highly desirable to vary the temperature and carry out the contraction procedure stepwise. This prevents creases from forming at the time of contraction, and produces an especially good, smooth felt. In this case, two-stage contractability is required of the fiber.

In order to prevent operating difficulties during the removal of one component before or after contraction, it is preferable to carry out a sizing operation. Water-soluble sizing agents such as, for example, polyvinyl alcohol and carboxy methyl cellulose may be used. However, when the density of the felt after contraction is at least about 0.4 g/cm$^3$, the operational difficulties during the step of removing one component may be avoided, even if such sizing is not carried out.

One component is removed from the contracted felt; this may be done easily by immersing the felt in a solvent. After removing one component, the felt is heat treated. The heat treatment is carried out by using heated air or a hot roll. It is preferred to carry out the heat treatment at a temperature ranging from about 160° C to 220° C for about 1–10 minutes. A few seconds suffice as the heat treating time for each fiber per se. However, in the case of a fiber aggregate such as a felt, heat transmission is slow and additional time is necessary to conduct the heat to the interior of the felt. However, because deterioration of the fiber is caused when too much time is allowed, or when the temperature is too high, it is necessary to limit the time and temperature. When a sizing agent is used, it is considered safe to limit the temperature to not more than about 190° C, because the sizing agent becomes insoluble at a higher temperature.

A binder is imparted to the fiber before or after such heat treatment. A binder of the polyurethane series is preferable. When the fibers are to be dyed later, a binder which is capable of withstanding dyeing is required. Preferable binders in this case include polyurethane of the polyester series and a part of polyurethane of the polyether series. Specifically, polytetrahydrofuran, polypropylene glycol and polycaprolactone are included. However, when dyeing is carried out under mild conditions or is not carried out at all, ordinary polyurethane may be used.

Upon applying the binder, it is used as a solution or emulsion. Solidification of the binder may be carried out either by the wet system or by the dry system. In the dry system, adhesion between the binder and the fiber is quite strong as compared to the wet system. Thus, it is preferable to make the amount of the binder somewhat smaller as compared with the case of the wet system. When using a solution, wet coagulation is preferable from the viewpoint of the hand or feel of the end product. When using an emulsion, it is preferred to heat treat the fiber at the same time, by annealing the emulsion polymer.

Just as in the heat treatment, the amount of the binder incorporated into the felt is very important for reduction of elongation, abrasion resistance and hand of the end product. In order to obtain an end product having a good hand, it is prefered to decrease the amount of binder added. However, when said amount is decreased, the elongation resistance and abrasion resistance of the end product become remarkably poor. In order to satisfy all of these characteristics, it is preferred to limit the apparent density of the fiber to about 0.08–0.35 g/cm$^3$ in the end product, the apparent density of the fiber containing the binder to about 0.17–0.52 g/cm$^3$, preferably 0.21–0.40 g/cm$^3$, and more preferably, to limit the amount of binder to about 20–60%, preferably about 26–50%, based on the weight of the fiber.

The resulting product is usable per se. However, it is highly desirable to buff the surface of the product to form a nap. The nap according to the present invention is soft, tends to form attractive and realistic finger marks when it is smoothed down by a finger working in different directions, and is lustrous and permanently entangled. A fiber whose denier is not more than about 0.45 is especially preferable.

The product of the present invention has high quality, improved compactness, and excellent hand, volume, abrasion resistance, elongation resistance and entanglement of nap.

In order to practice the present invention very effectively, it is preferable to utilize a polymer of the polyester series, because by so doing, a highly contractible fiber tends to be produced, and the effect of heat treatment after contraction is remarkable. Of the polymers of the polyester series, a copolymer is especially preferable which is obtained by copolymerizing isophthalic acid or adipic acid in an amount of about 4.5–20% based upon the weight of the polyester. When such a polymer is used, not only may the contractibility further be raised, but problems in dyeing may be solved in the same way.

When the nap of a superfine fiber is formed on the felt surface in accordance with the present invention, dyeing of the fibers tends to become difficult. That is to say, superfine filaments are difficult to color sufficiently, because of its large curvature to reflect or scatter light to make the color look pale. Accordingly, it is necessary to dye the fiber in a deeper color. However, heretofore, when the concentration of the dyestuff was increased for the purpose of dyeing the fiber in a deeper color, it has not been able to dye the fiber in a deep color. Accordingly, it was concluded at one time that it would be impossible to dye such superfine fiber in a deep color. However, as a result of our study conducted after that, it was found that, at the time of dyeing, the dyestuff is mainly absorbed by the binder and not absorbed sufficiently by the fibers. However, after dyeing, the dyestuff falls off from the binder, by washing with water. Accordingly, it may be said that however high the concentration of the dyestuff may be, excess dyestuff is trapped in the binder and is not sufficiently effective for dyeing the fiber. Raising the concentration of the dyestuff to an extent of more than saturating the adsorbed amount of the dyestuff by the binder means throwing away a large amount of the expensive dyestuff.

We have discovered that such problems may be overcome by using a copolyester containing about 4.5–20% of isophthalic acid or adipic acid. In the simultaneous dyeing of such polymer and binder, the dyestuff increases its affinity with the fiber and part of the dyestuff moves from the binder to the fibers. Accordingly, it now becomes possible to dye the fibers in a deep color, and the loss of dyestuff becomes very small.

In such dyeing, the dyeing temperature is very important. When the dyeing temperature is raised, the dyestuff tends to prefer to attach itself to the fibers, but when the dyeing temperature is low, the dyestuff tends to move to the binder side. It is necessary to determine the dyeing temperature by balancing the two factors. Especially, it is preferred to establish the dyeing temperature in the case of such copolymers at about 5°–25° C lower than the temperature usually adopted for homopolyesters. Accordingly, when polyethylene terephthalate is selected as the polyester, it should be dyed at a temperature ranging from about 105° C to 120° C.

The effect of being able to lower the temperature at the time of dyeing is great. Deterioration of elastic binders having poor heat resistance may be prevented.

In order to carry out good dyeing, the concentration of the dyestuff is also important. When a sheet is dyed somewhat more deeply than usual with respect to color, it is recommended to use at last 10% of dyestuff based on the weight of the sheet.

Processing after dyeing is also important. In the case of a sheet material which is a composite of the binder and the fiber, the adhesion of the two remarkably influences the hand of the product. Even after dyeing, the hand and nap quality of the product are remarkably influenced by swelling or contraction of the binder. For instance, treating the sheet after dyeing at a pH of about 7–14 and at a temperature of about 40°–98° C, the hand, volume, softness and dye fastness of the product are remarkably advanced.

The influence of the drying conditions upon the hand of the product is also great. It is better slowly to effect drying at a low temperature and reserve about 0.5–2% (based on the weight of the product) as the moisture content ratio, than suddenly and completely to effect drying at a high temperature. Also, at the time of drying, the condition of the nap is remarkably influenced. In order to form a soft nap tending to take on realistic finger marks, it is preferred to make the nap into the desired state by brushing or by abrasion while the product is wet, before or at the time of drying, and thereafter to dry the nap.

As mentioned above, according to the present invention, a leather-like sheet material having an apparent density of at least about 0.17 g/cm$^3$, preferably about 0.21–0.35 g/cm$^3$, having excellent hand, volume, dyeability, elongation resistance and abrasion resistance is obtained. Especially, when such a sheet material has nap on its surface, the nap becomes compact, tends to be marked with finger marks, and the fibers of the nap are not likely to become entangled.

The resistance of the product to elongation may be determined by the following measuring method, and may be expressed as a deformation ratio.

Both ends of a sample (width 2 cm and length 10 cm) are gripped by clamps and pulled by a tensile tester at a tensile speed of 10 cm/min. When the load of the sample becomes 1.5 kg. per perpendicular cross-sectional area, 1 $cm^2$ of the initial sample, pulling is stopped and the clamps are restored to their original positions. The operation is repeated 5 times. After completion, the sample is released and allowed to stand for 2 hours. Thereafter, the length of the sample is measured, and reported as L (cm). The deformation ratio is:

$$\text{Deformation ratio} = \frac{L-10}{10} \times 100\ (\%)$$

When the deformation ratio is large, the product tends to deform easily and at the time of using, when the product is used, for example, for clothing, it causes deformation of the clothing. For actual use, it is necessary that this deformation ratio be not more than about 12%, and it should preferably not exceed about 8%.

Abrasion resistance of the synthetic leather may be determined as a chafing number, as follows.

On a 90 mm diameter table, a sample of the same shape is fixed by means of a frame. From above onto the entire plane of 90 mm diameter, a brush having 8000 monofilaments of polycaprolactam (diameter 0.3 mm $\phi$, length 20 mm) implanted uniformly is pressed with a load of 8 pounds. This brush is rotated. The rotary axis of the brush and the rotary axis of the table are eccentrically disposed by 15 cm. The table fixed with the sample, and the brush itself, are rotated at 62.5 rpm and 58 rpm, respectively in the same direction. The total number of rotations of the brush from the start of rotation until the sample is damaged (wears out and holes are made) is defined as the chafing number. When the chafing number is large, abrasion resistance is good.

Susceptibility to entanglement of the nap is measured by a micro-fiber adhering method, as follows.

Both ends of a sample are sewn to make a cylinder having an inner diameter of 4 cm and a length of 13 cm. This sample is thrown into a 15 cm × 15 cm × 40 cm cuboidal box the interior of which is covered with cork rotating at 30 rpm around an axis in the lengthwise direction, together with 3 g of superfine rayon fiber passing through a 100-mesh sieve. After rotating the box for 10 minutes, the contents are taken out, and dropped from a height of 5 cm onto the floor surface twice to eliminate excess fiber dust. Thereafter, the weight is measured and called $W_1$. Next, after removing the fiber dust adhering to the surface of the sample completely by using a vacuum absorption apparatus, the weight of the sample is measured. The weight of the sample at this time is called $W_2$. The susceptibility to entanglement of the nap is determined from the equation $$W = W_1 - W_2$$

When W is high, it shows that nap tends to become entangled rather readily.

EXAMPLES 1 – 8, CONTROLS 1 – 4

These examples and controls show ester interchange reactions and occurence or otherwise of gelation caused by such reactions when polyester and vinyl esters group co-exist in the molten state. These examples relate to a composite fiber yarn which is a binary fiber consisting of polyester as one component and a polymer of the vinyl series containing a carboxylic acid alkyl ester group as the other component in observing stability (whether gelation occurs) at the time of melt spinning.

As the polymer of the vinyl series containing a carboxylic acid alkyl ester group, these examples and controls used a styrene-acrylic acid ester copolymer at a fixed copolymerization ratio (by weight) of 80 parts of styrene and 20 parts of acrylic acid ester. Such systems in which the acrylic acid ester was varied were prepared by block polymerization in ampoules using benzoyl peroxide as an initiator. Each of such polymers was immersed in liquid nitrogen and broke into fine pieces and these fine particles and finely cut polyethylene terephthalate fibers were mixed at a weight ratio of 8:2, the mixture was sealed in a glass tube (ampoule) and heated in a nitrogen atmosphere at 280° C for 4 hours. After cooling, the solid product was taken out and immersed in trichloroethylene at a ratio of 4 g of solid per 200 cc of trichloroethylene. The state of dissolution was observed, to check gel floatage. The results were as shown in Table 1.

R in Table 1 means the R group of the terminal —COOR of a carboxylic acid alkyl ester (ROH means an alcohol and —COOR means an ester of that alcohol).

Table 1

| Example | R | Gel floatage | Reference ROH | Boiling point of ROH* |
|---|---|---|---|---|
| Control 1 | Ethyl | Considerable (transparent gel) | Ethyl alcohol | 78.3° C |
| Control 2 | Butyl | Considerable (transparent gel) | Butyl alcohol | 117.7° C |
| Control 3 | Pentyl | Gel occurred a little | Pentyl alcohol | 137.8° C |
| Control 4 | 3-Pentyl | Gel occurred | 3-Pentyl alcohol | 115.6° C |
| Example 1 | Octyl | No gel | Octyl alcohol | 195° C |
| Example 2 | 2-Octyl | " | 2-Octyl alcohol | 178° C |
| Example 3 | 2-Ethylhexyl | " | 2-Ethylhexyl alcohol | 184.8° C |
| Example 4 | 3,5,5-Trimethyl heptyl | " | 3,5,5-Trimethyl heptyl alcohol | 194° C |
| Example 5 | Nonyl | " | Nonyl alcohol | 173.3° C |

Table 1-continued

| Example | R | Gel floatage | Reference ROH | Boiling point of ROH* |
|---|---|---|---|---|
| Example 6 | Trimethyl nonyl | " alcohol | Trimethyl nonyl | 225.2° C |
| Example 7 | Cetyl | " | Cetyl alcohol | 344° C |
| Example 8 | Stearyl | " | Stearyl alcohol | Sufficiently high |

NOTE:
*at 760 mm Hg

From the results of Table 1, it is understood that occurrence or otherwise of gel is influenced by the terminal group R of the carboxylic acid ester group. When R is ROH and the boiling points of such alcohols are compared, with the boiling point of about 150° C as a boundary, occurrence or otherwise of gel is influenced. On the low boiling point side, occurrence of gel is very noticeable. While on the high boiling point side, occurrence of gel becomes less, and is eventually not recognizable.

Namely, in a system in which a polymer of the vinyl series co-exists with a polyester and the polymer of the vinyl series contains a vinyl ester group as in the case of the present invention, it is necessary to select, as said ester, one in which R, when converted into ROH, will have a boiling point of at least 150° C.

EXAMPLES 9 – 12, CONTROLS 5 – 8

These examples and controls show the stability of polymers of the vinyl series according to the present invention at the same time of actual spinning, and the drawability at low temperatures of such fibers.

A copolymer of 2-ethylhexyl acrylate by 20 parts with styrene by 80 parts, having an HDT of 60° C, an elongation in hot water at 70° C of 53% and a shrinkage in hot water at 85° C was used as the sea component of an islands-in-a-sea type composite fiber and polyethylene terephthalate (copolymerized with 9.9 mol % of isophthalic acid), having an intrinsic viscosity measured in ortho-chlorophenol at 25° C of 0.70 and a softening point of 239° C, was used as the island component of said fiber and spinning was carried out at an islands/sea ratio of 50/50, with 16 islands present per filament, and using a spinning temperature of 282° C to obtain filament yarns of 10 denier respectively. The spinning conditions were very stable and bending and instability or vibration of the filaments at the spinneret were not observed. The resulting undrawn yarn was drawn in a hot bath to check its drawability.

Table 2 shows the results of this experiment.

Table 2

| Example | Temperature of draw bath | Maximum draw ratio | Draw ratio at which whitening began * | Drawn islands-in-a-sea composite yarn Tensile strength | Drawn islands-in-a-sea composite yarn Elongation | Island component** Tensile strength | Island component** Elongation |
|---|---|---|---|---|---|---|---|
| 9 | 70° C | 3.05 | 2.76 | 1.93 g/d | 19% | 2.4 g/d | 12.7% |
| 10 | 80° C | 3.32 | 3.21 | 2.61 g/d | 20% | 3.5 g/d | 67% |
| 11 | 85° C | 3.58 | 3.24 | 2.85 g/d | 28% | 3.8 g/d | 47% |
| 12 | 98° C | 4.20 | Not whitened | 4.01 g/d | 21% | 5.7 g/d | 32% |

NOTE:
*Whitening is a phenomenon whereby a fiber is devitrified due to the strain of drawing, which is considered to be derived from interphase peeling between the sea component and the island components, or from occurrence of micro voids in a sea component which has poor drawability. When the fiber whitens, many broken monofilaments are usually mixed.
**The island component filament remained after the sea component was removed from the drawn islands-in-a-sea type composite yarn by trichloroethylene.

Table 3 shows examples (and controls) using ordinary polystyrene instead of using the copolymer according to this invention as the sea component.

Table 3

| Control | Temperature of draw bath | maximum draw ratio | Draw ratio at which whitening began | Drawn islands-in-a-sea composite yarn Tensile strength | Drawn islands-in-a-sea composite yarn Elongation | Island component Tensile strength | Island component Elongation |
|---|---|---|---|---|---|---|---|
| 5 | 70° C | 1.8 | 1.8 | 0.9 g/d | 14% | 1.2 g/d | 183% |
| 6 | 80° C | 2.1 | 1.5 | 1.1 g/d | 18% | 1.7 g/d | 150% |
| 7 | 85° C | 2.78 | 2.0 | 1.3 g/d | 21% | 2.0 g/d | 131% |
| 8 | 98° C | 3.10 | 2.6 | 1.98 g/d | 31% | 2.9 g/d | 91% |

From Tables 2 and 3, it will be understood that the present invention is by far superior with reference to drawability. Fibers having high tensile strength and good elongation are obtained according to the present invention.

It is relevant to make a comparison between the elongation in an islands-in-a-sea type composite fiber and the elongation of the island component after removal of the sea component. In the examples of the present invention, it is possible to make the draw ratio high and the orientation of the island component proceeds sufficiently and the elongation property is excellent.

On the other hand, in the cases of the comparative examples, the draw ratio cannot be made high enough; it is limited by the fact that polystyrene has poor drawability. Accordingly, the polyethylene terephthalate, which is the island component, is still almost undrawn, or at best not drawn enough. Accordingly, with reference to the physical properties of island component, the present invention is by far superior.

EXAMPLE 13

This example shows a method of effectively utilizing the present invention.

Polyethylene terephthalate copolymerized with 5 mol percent of isophthalic acid was used as the island component of an islands-in-a-sea type composite fiber. The product obtained by copolymerizing 80 parts of styrene and 20 parts of 2-ethylhexyl acrylate was used as the sea component. The fiber was spun at a ratio of islands/sea of 52/48 and 16 islands/filament to obtain a 10 denier × 84 filament undrawn yarn. The spinning process was very stable and no traces of gel could be recognized after dismantling the pack. Using the undrawn yarn, drawing was carried out while varying the drawing conditions. The results are shown in FIG. 3.

Figure 3:
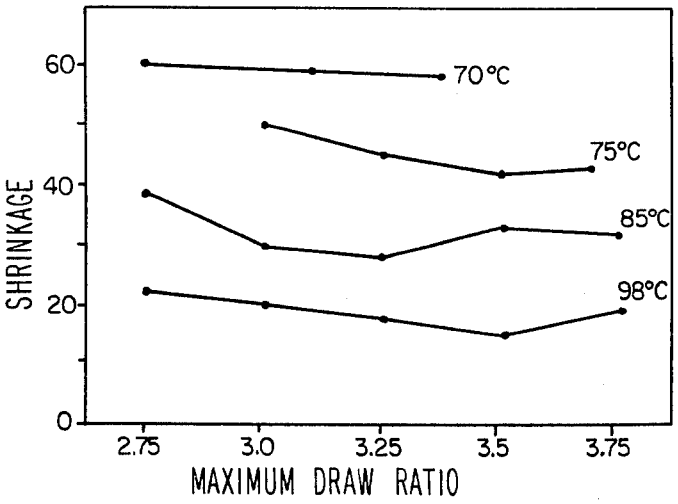
FIG. 3 is a chart showing the relationship between draw ratio and shrinkage in boiling water of a fiber according to the present invention.

As will be apparent from FIG. 3, the shrinkage was greatly affected by the drawing temperature. In order to make a highly contractible fiber, the fiber had to be drawn at a low temperature, and the object could be achieved easily and effectively by combination of the polymers of the present invention only.

CONTROL 9

Example 13 was repeated, except using a styrene (80 parts)/ethyl acrylate (20 parts) copolymer as the sea component in spinning.

After spinning for 5 hours, the pack was dismantled, the spinneret was taken out and cooled. Thereafter, it was immersed in trichloroethylene. Even after 20 hours, the sea component polymer had not dissolved and the spinneret was still blocked with swollen gel.

EXAMPLE 14

Upon obtaining a sheath-core type composite fiber, polybutylene terephthalate was used as core component and a styrene (90 parts)/stearyl methacrylate (10 parts) copolymer (having an HDT of 53.8° C, an elongation in hot water at 70° C of 250% and a shrinkage in hot water at 85° C of 58%) was used as the sheath component. They were spun at a ratio of sheath/core of 65/35 to obtain a 12 denier × 24 filament undrawn yarn.

This yarn was drawn 3.6 times in a hot bath at 90° C. A transparent, lustrous yarn having a good drawability was obtained. After spinning, there was no blockage of the spinneret by gel.

EXAMPLE 15

30 parts of polyethylene terephthalate copolymerized with 7 mol % of adipic acid and 70 parts of a terpolymer of 2-ethylhexyl acrylate (10 parts)/stearyl methacrylate (5 parts)/styrene (85 parts) (having an HDT of 54.7%, an elongation in hot water at 70° C of 149% and a shrinkage in hot water at 85° C of 48%) were so spun that the resultant undrawn yarn had a nebulous cross-section. Such fiber made a laminar composite stream and by passing a sand layer and the like, it was easily spun. The undrawn yarn was drawn 3.5 times in a hot bath at 80° C. It showed very good drawability and a good, lustrous yarn free of devitrification was obtained. Gelation after spinning was not observable.

EXAMPLE 16

Polyoxy benzoate was used as an island component of an islands-in-a-sea type composite fiber and a terpolymer consisting of 5 parts of nonyl acrylate, 15 parts of 2-octyl acrylate and 80 parts of styrene (having an HDT of 57.8° C, an elongation in hot water at 70° C of 130% and a shrinkage in hot water at 85° C of 45%) was used as a sea component of composite fiber in carrying out spinning at an islands/sea ratio of 55/45 and 16 islands/filament. The resulting undrawn yarn was drawn 3.6 times in a hot bath at 85° C to obtain a 3.2 denier transparent staple free of devitrification.

On the other hand, the above procedure was repeated except for using polystyrene as a sea component in carrying out spinning and drawing, in which case the draw ratio was limited to 3.2 and a devitrified yarn having a coarse surface was obtained.

Both of these yarns were repeatedly passed through a card 5 times under the same conditions to observe the coiled arrangement of the fibers around the card. In the case wherein the copolymer, according to the present invention, was one component, it was observed that the fiber did not coil around the card at all. However, in the case of the fiber of the conventional example using polystyrene only as the sea component, occurrence of neps was recognized from and after the second time the yarn was passed through the card, and the occurrence of neps became very noticeable from the fourth time the yarn was passed to the card and thereafter. When these neps were observed, the sea component split and the minute island components were exposed and entangled to cause the neps.

EXAMPLE 17

A polymer consisting of 25 parts of 2-ethylhexylacrylate, 75 parts of styrene and 0.01 part of divinyl benzene having an HDT of 50.3° C, an elongation in hot water at 70° C of 1130% and a shrinkage in hot water at 85° C of 68% was used as the sea component of an islands-in-a-sea type composite fiber. Polyethylene terephthalate (intrinsic viscosity 0.70) was the island component of the composite fiber. Spinning was carried out at a ratio of islands/sea of 49/51 and 16 islands/filament at 278° C. The spinnability was very good; an undrawn yarn was produced having a stable cross-section in which the island components were uniformly distributed. The undrawn yarn was drawn 3.4 times in hot bath at 70° C to obtain a 3.0 denier highly contractible yarn having a boiling water shrinkage of 33.8%. The yarn was passed through crimping apparatus to be imparted with crimps of about 10 crimps/2.54mm. However, splitting of the sea component at the sharp points of the crimp was not recognized. Using the yarn (cut length 51 mm), a web was formed using a cross lapper. The web had a weight per unit area of 570 g/m$^2$. This felt was needle punched to produce a high-density felt having a punch density of 1700 punches/cm$^2$ and an apparent density of 0.202 g/cm$^3$.

This felt was immersed in hot water at 80° C and thereafter immersed in polyvinyl alcohol solution. Subsequently, being dried, it was immersed in trichloroethylene to dissolve the sea component of the fiber. Then it was followed by impregnation with polyurethane, coagulation and a napping treatment to create a velcur-like leathery sheet material having unprecedented characteristics and properties.

CONTROL 10

Example 17 was repeated, but using polystyrene as the sea component. The spinning process was good; however, the undrawn yarn could be drawn only 1.8 times to avoid partial whitening and yarn breakage.

Using the drawn yarn, a web was formed, which was needle punched in the same way as in Example 17; however even when punching was carried out to a punching density of 3000 punches/cm$^2$, the apparent density of the felt was saturated at 0.155 g/cm$^3$. Using the resulting felt, a velour-like leathery matter was made; however, it was far inferior to the velour-like leathery material obtained in Example 17. Using the fibers according to the present invention, the felt-forming properties were very good, and the resulting felt became a high-density compacted felt. In the control, the felt forming property was remarkably poor. Because of the hard properties of polystyrene, the fiber became hard and strong in its repulsive properties, and intertwinement did not take place easily.

CONTROL 11

This control shows the examined results of the case of using a plasticizer for the purpose of improving drawability and flexibility of polystyrene. Although this is one example of the use of a plasticizer, it is a representative example illustrating limitations in the use of plasticizers.

DOP (dioctyl phthalate) is used as a plasticizer for styrene. A polystyrene polymer, into which 3% by weight of DOP was added, was spun at 285° C. The spinning pressure at the time of spinning was reduced by about 31% as compared to that of a blank polystyrene polymer containing no DOP. The spun polymer was taken up at a take-up speed at 400 m/min to obtain an undrawn yarn of about 10 denier.

This undrawn yarn was pulled through a liquid at 70° C at a speed of 10 m/min and its elongation at break was measured. The increase of elongation of the undrawn yarn spun from the polymer containing 3% of DOP was only 1.8%, as compared to an undrawn yarn spun from the polymer which contained no DOP, and no substantial plasticizing effect was recognized. Whereas, as a peculiar functional effect of such plasticizer, there was a remarkable, undesirable action of promoting lowering of the viscosity of the molten polymer, not expected from the small plasticizing effect at the time of cooling. Specifically, by adding only 3% of the plasticizer, the pack pressure (filter pressure) at the time of spinning decreased by as much as 31% as compared with that of the blank polymer not containing any plasticizer. The effect of the plasticizer became very remarkable at the time of melting.

This polystyrene polymer containing 3% of the plasticizer was used as the sea component of an islands-in-a-sea type composite fiber, and polyethylene terephthalate (intrinsic viscosity 0.72) was used as the island component. They were spun at an islands/sea ratio of 50/50 and by a 16 islands/filament spinneret at 285° C. After discharging the sea component, the islands component was discharged, establishing the component ratio at a predetermined value. Though immediately after the discharged amounts were mixed, take-up was started. Immediately after take-up, the discharging conditions were normal and the undrawn yarn had a normal sectional configuration in which the island components were uniformly distributed, about 3 hours after the start of the discharging operation, polymer flow began to bend immediately after it was discharged from the spinneret and a disordered spinning condition was observed. Further, 4 hours later, bending of the undrawn yarn became extreme, the yarn adhered to the spinneret surface. Drips began to occur. At this point variation of denier among the holes of the spinneret began to be seen.

When the cross sections of such yarns were observed, the island components adhered to each other, composite unevenness (component ratio unevenness) was sharp and, in an extreme manner, the island components and the sea component existed as completely independent monofilaments in admixture among the holes (toward each hole of the spinneret). In a yarn using a polystyrene homopolymer not containing the plasticizer as the sea component, there was no occurrence of such disorder because, by addition of the plasticizer, the viscosity at the time of melting lowered, difference of viscosity values between the island components and the sea component became extremely large and the spinning process became remarkably unstable.

The undrawn yarn obtained immediately after the start of discharging was drawn in a hot bath at 98° C. However, it could be drawn only 2:7 times and no substantial effect of addition of plasticizer on drawing was recognized.

CONTROL 12

A system in which liquid paraffin was added into polystyrene was used in carrying out spinning and drawing as an islands-in-a-sea type composite fiber, otherwise the same as in Comparative Example 11.

As the ratio of liquid paraffin added to the polystyrene, the various levels of 0, 5, 10, 15 and 20% were selected. When 15% of liquid paraffin was added to the polystyrene, the melt viscosity of the polystyrene lowered too much and spinning was impossible. The spinnable limit occurred at a ratio of liquid paraffin of 10%. Accordingly, the undrawn yarns were provided with 0%, 5% and 10% of liquid paraffin. These undrawn yarns were drawn in a liquid bath at 80° C. The results in terms of draw ratio were 2.0 in the case of 0% (blank), 2.3 in the case of 5% and 2.4 in the case of 10%. By addition of liquid paraffin, drawability was slightly improved. However, there was no substantial difference between addition of 5% and 10%, and the effect of the amount added per se was small. As reasons for this, it is conceivable that by making the polymer into a yarn at the time of spinning, the high temperature surface area becomes very large, from which an excess of plasticizer evaporates. A low boiling point plasticizer evaporates at the time of spinning, having no effect; a high boiling point plasticizer does not develop its effect sufficiently at the time of drawing.

EXAMPLE 18

Using a biaxial extruder-type spinning machine, a mixed chip of 35 parts of polyethylene terephthalate and 65 parts of a styrene-stearyl acrylate (75/25) copolymer was spun. As a control, mixed chips of 35 parts of polyethylene terephthalate and 65 parts of polystyrene were spun using the same spinning machine. The two different undrawn yarns were drawn in a hot bath at 80° C to check the drawing conditions.

Table 4

| | This invention | Control |
|---|---|---|
| Maximum draw ratio | 3.4 | 2.7 |
| Yarn breakage at the time of drawing* | | 9.3 times/min |

*Frequency of occurrences in which the yarn coiled around the roller, per minute, when drawing was carried out at a draw ratio of 0.95 × maximum draw ratio.

From these results, the good drawability of the yarns according to the present invention should be understood.

EXAMPLE 19

A 2-ethylhexyl acrylate (20 parts)/styrene (80 parts) copolymer was used as the sea component and a polyethylene terephthalate copolymer copolymerized with 5 mol % of isophthalic acid was used as the island component in carrying out spinning at an islands/sea ratio of 50/50 and 16 islands/filament as an islands-in-a-sea type composite fiber.

No chimney was used in the spinning procedure and the resulting undrawn yarn was taken up through a hot tube provided 1.5 m directly below the spinneret. The atmospheric temperature of said tube was controlled at 240° C. The undrawn yarn was drawn 4.2 times at 82° C and a highly contractible yarn having a shrinkage in boiling water of 34% was obtained.

The Young's modulus determined from mesured strain-stress curve of the sea component filament after dissolving the sea component after contraction was very high for the shrinkage.

EXAMPLE 20

In Examples 9 – 19, when the resulting drawn yarns were immersed in trichloroethylene and washed, the sea components dissolved more easily and operations for washing and removing the sea components were easier than in the case of polystyrene alone.

And because the draw ratios were high, the tensile strength of the remaining island components were remarkably high (see Tables 2 and 3).

EXAMPLE 21

Example 9 was repeated, except using polyethylene terephthalate as the island component and changing the draw ratio to 3.5 in making a 3.5 denier stream (about 96° – 98° C) drawn yarn. This yarn was small in elongation (the island component too) and small in contractibility and was an excellent fiber. About 8 – 12 crimps/in were imparted to the yarn, which was made into 51 mm cut staple and 76 mm cut staple. When these staple samples were subjected to ordinary staple system and woolen system spinning to make 16S/2 and 2/12 spun yarns, respectively, they became good spun yarns having very little occurrence of fly and white powder. Used as warps a false twisted filamentary yarn (150 denier) and using as weft, each of the aforesaid spun yarns, these warp and weft yarns were woven into Turkish satin fabrics, respectively.

It was possible to form a very good nap on the surfaces of these satin fabrics by subjecting them to the action of a napping machine using a card cloth before or after removing the sea component.

For information, with reference to fly and white powder, when the sea component is substantially only polystyrene regardless of being mixed or not mixed with about 0.5% of liquid paraffin, there is a considerably large amount of fly or white powder at the time of spinning, especially at a yarn uniting or twisting machine and at a spinning winder. On the contrary, in the present invention, because drawing is not carried out to the upper limit, but it is possible to give room to drawing (and because the yarn is tenacious), it is possible to avoid the creation of objectionable amounts of fly and white powder.

EXAMPLE 22

This example shows the importance of the copolymerization ratio.

| Polymerization conditions: | |
|---|---|
| Catalyst: | 0.2 parts based on the weight of monomer of benzene peroxide<br>0.1 parts based on the weight of monomer of ter-butyl perbenzoate |
| Water/monomer: | 150/100 (suspension polymerization) |
| Polymerization time: | 6 hours at 100° C<br>2 hours at 120° C |

Figure 4:
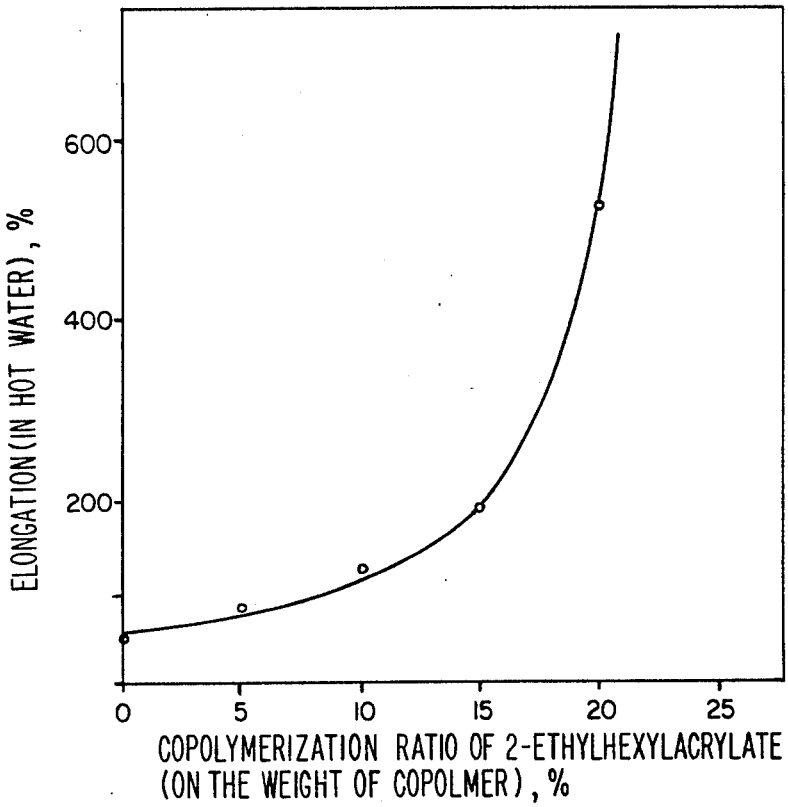
FIG. 4 is a chart showing the relationship between copolymerization ratio and the drawability (elongation) of a polymer according to the present invention.

Making the above conditions constant and varying the copolymerization ratio of 2-ethylhexyl acrylate/styrene of the charged monomers, polymerizations were carried out. The drawability (elongation) of the polymers was checked by the method mentioned in the text of the specification. The results appear in FIG. 4. As will be apparent from FIG. 4, from a point where the copolymerization ratio is about 10%, the polymers begin to elongate well. From the point where the copolymerization ratio is about 15% as a boundary, the polymer suddenly begins to elongate well, which is a characteristic of the present invention. This fact shows that a copolymerization ratio of not less than 10% is very important for achieving some of the important objects of the present invention.

EXAMPLES 23 – 28

Controls (Comparative Examples) 12 – 14

In Example 7, the atmospheric temperature at a point 10 cm directly below the spinneret was controlled at 40° C, 150° C and 250° C in taking up the undrawn yarn.

Draw tests of the resulting undrawn yarns were carried out. They obtained the following results:

Table 5

| | Sample No. | Temperature below spinneret | Preheat temperature | Draw temperature | Draw speed | Maximum draw ratio** |
|---|---|---|---|---|---|---|
| Control 12 | H-1 | 40° C | R.T. | 70° C | 150 m/min | 3.28 times |
| Control 13 | H-2 | 40° C | 40° C | 70° C | 150 m/min | 3.33 times |
| Control 14 | H-3 | 40° C | 70° C | 70° C | 150 m/min | 3.5 times |
| Example 23 | H-4 | 150° C | R.T. | 70° C | 150 m/min | 3.82 times |
| 24 | H-5 | 150° C | 40° C | 70° C | 150 m/min | 3.91 times |
| 25 | H-6 | 150° C | 70° C | 70° C | 150 m/min | 4.17 times |
| 26 | H-7 | 250° C | R.T. | 70° C | 150 m/min | 3.88 times |
| 27 | H-8 | 250° C | 40° C | 70° C | 150 m/min | 4.17 times |
| 28 | H-9 | 250° C | 70° C | 70° C | 150 m/min | 4.17 times |

NOTE:
*R.T. = room temperature
**Maximum draw ratio = elongation at break

From the aforementioned results, it was found that when the temperature at a point below the spinneret is high, drawability is good. By increasing the preheat temperature, drawability advances.

EXAMPLE 29

The heat stability of a styrene (78 parts)/2-ethylhexyl acrylate (22 parts) copolymer was checked.

| Method of estimating heat stability: | |
|---|---|
| In $N_2$ gas: | 20 cc/min |
| Amount of the sample: | 400 mg |
| Temperature 285° C | (temperature was raised from room temperature to 285° C at a rate of 10° C/min) |

Figure 5:
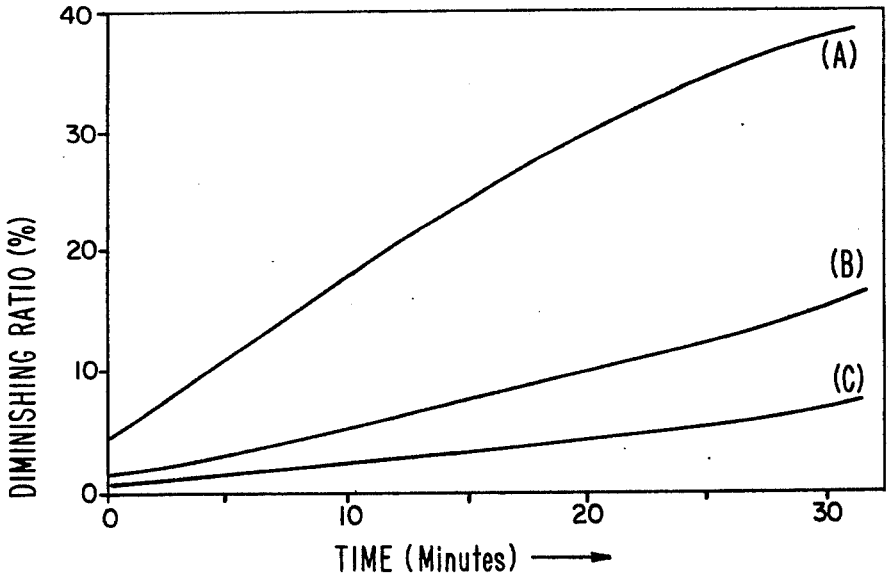
FIG. 5 is a chart showing the heat stabilization of a polymer according to the present invention.

The weight diminished ratio of the polymer in the aforementioned atmosphere was checked. The results are shown in FIG. 5, wherein:

A. is a thermal decomposition curve of the sample pelletized at 245° C. The decomposition ratio is remarkably high.

B. is a thermal decomposition curve of the sample pelletized at 215° C. By reducing the temperature to 215° C, the thermal decomposition was remarkably improved.

C. is a thermal decomposition curve of the sample added with a thermal decomposition stabilizer. It was found that a beneficial effect (to this polymer) was obtained by addition of a thermal decomposition stabilizer (1,3,5-trimethyl-2,4-6-tris (3,5-di-ter-butyl-4-hydroxybenzyl) benzene).

EXAMPLE 30, CONTROL 15

A styrene (78 parts)/2-ethylhexyl acrylate (22 parts) copolymer having an HDT of 54.5° C, an elongation in hot water at 70° C of 590% and a shrinkage in hot water at 85° C of 58% was used as the sea component of an islands-in-a-sea type composite fiber. An isophthalic acid copolymerized polyethylene terephthalate having a softening point of 235° C was used as the island components of said composite fiber in carrying out spinning at an islands/sea ratio of 50/50, and with a total of 16 islands/filament. The resulting undrawn yarn was wound at a speed of 1070 m/min under such conditions that the temperature at a point 10 cm directly below the spinneret was 92° C and 298° C. These undrawn yarns were drawn in hot water at 70° C to check the maximum draw ratio. The results were as follows:

| | Atmospheric temperature directly below spinneret | Maximum draw ratio |
|---|---|---|
| Control 15 | 92° C | 3.3 times |
| Example 30 | 298° C | 4.02 times |

A great difference in maximum draw ratio was observed with changes of atmospheric temperature at a point directly below the spinneret. By raising said temperature, it is possible remarkably to raise orientation of the yarn, and the spinning productivity as well.

EXAMPLE 31

In Example 30, the undrawn yarn was drawn at a ratio of 3.92, and crimp was imparted to the drawn yarn. A stuffer box type crimper was used, a fiber oiling agent kept at a constant temperature (15° C) was flowed to cool the crimper, and the roll surface temperature of the crimper was kept at 38° C. The yarn product showed a shrinkage of 40.3%.

CONTROL 16

As in Example 31, the temperature on the surface of the crimper was changed to 62° C. The resulting yarn had a shrinkage of 28.7%.

EXAMPLE 32

The yarn obtained in Example 31 was dried at 40° C. Its shrinkage was 40.2% and no change of shrinkage by drying was observed.

CONTROL 17

As in Example 32, the drying temperature was 65° C. The shrinkage of the yarn, after drying, was 11.2%.

EXAMPLE 33

The yarn in Example 32 was subjected to a card and to a cross lapper to form a web. This web was needle punched to make a felt having an apparent density of 0.173 g/cm$^3$. A good felt in which punched traces were almost unrecognizable was obtained. This felt was immersed in hot water at 55° C and then in hot water at 85° C, and lightly rolled by rolls to obtain a flat contracted felt. As a result of measuring the shrinkage, it was found that the felt contracted by 24% in area at 55° C, and contracted to 56% of the original area at 85° C. The contracted felt was excellent and free from creases.

This felt was impregnated with an 18% aqueous solution of polyvinyl alcohol and dried at 80°C. After drying, the felt was immersed in trichloroethylene and the sea component was dissolved and removed. Next, the felt was heat treated in hot air at 180° C for 5 minutes, impregnated with DMF (dimethyl formamide) solutions of various concentrations of polyurethane whose soft segment was polytetrahydrofuran having a molecular weight of about 2000 and whose hard segment consisted of p,p'-diphenylmethane diisocyanate and p,p'-diaminodiphenyl methane, and then the felt was immersed in hot water at 90° C to remove PVA (polyvinyl alcohol) and sliced along the center into two halves. Both surfaces of the sliced substrate were buffed with sandpaper. After buffing, the sheets were dyed a chestnut color with a dispersed dyestuff at 115° C.

The product had an apparent density of 0.24 – 0.32 g/cm$^3$, a bright color and excellent hand and volume, being free from nap entanglement. The elongation resistance and abrasion resistance were measured, and the results are shown in FIGS. 7 and 8, respectively.

Figure 7:
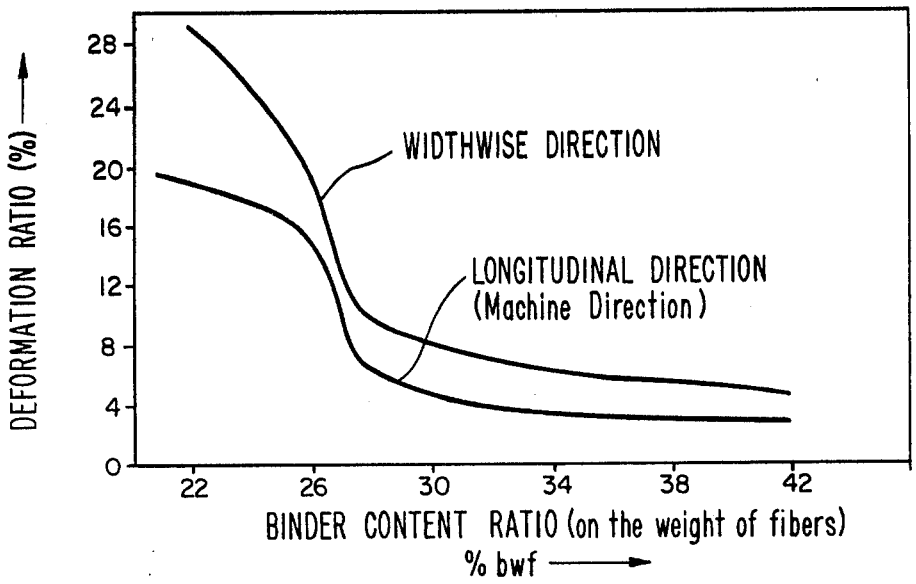
FIG. 7 is a chart showing the deformation of a product of a fiber according to the present invention, plotted against binder content.

FIG. 7 shows the relation between the binder content ratio and the deformation of the product. It was found that at a binder content ratio of not less than 26%, a remarkable improvement was achieved and the deformation could be controlled to a value of not more than 12%, which is within the range demanded for practical use.

Figure 8:
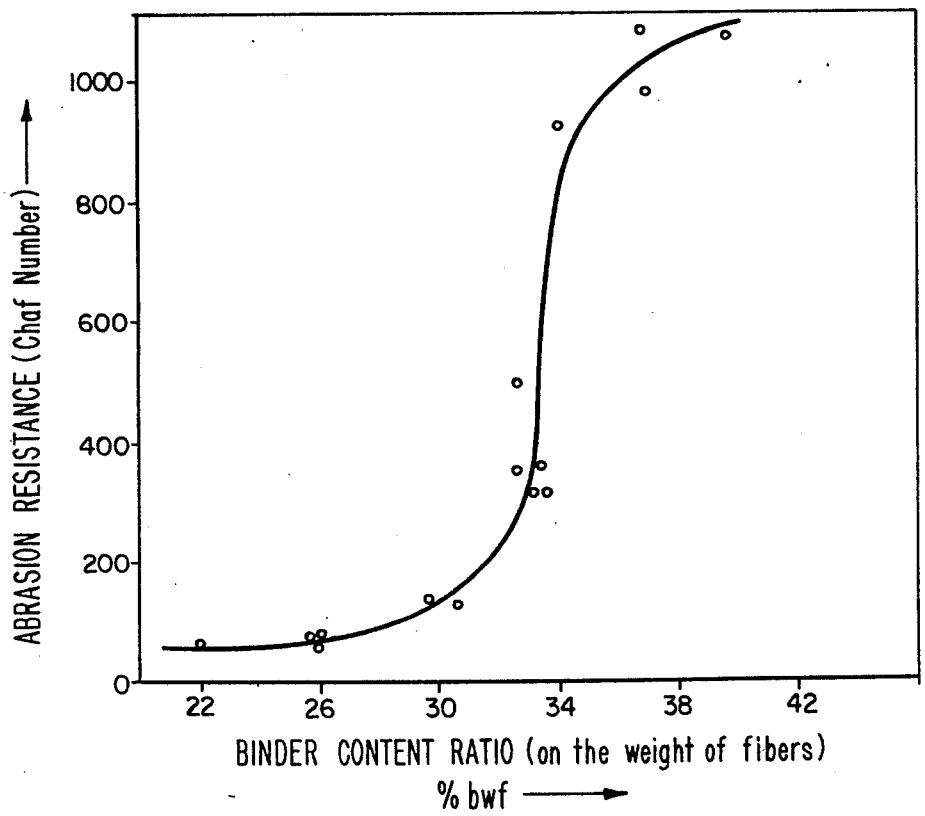
FIG. 8 is a chart showing the abrasion resistance (chafe number) of a product made of fibers according to the present invention, plotted against binder content.

FIG. 8 shows the results of measuring abrasion resistance. The thickness of the sample upon measuring the chafing number was made the actual thickness. The thickness of this sample was 0.8 mm. It was found that with a binder content ratio of about 33%, the abrasion resistance (chafing number) was remarkably improved.

CONTROL EXAMPLE 18

Example 33 was repeated except for omitting the heat treatment. When the deformation ratio was measured at the binder content ratio of 34%, it was 13.2%. And it was found that heat treatment is remarkably effective for improving quality.

CONTROL 19

Example 33 was repeated except for limiting the contraction to one contraction at 55° C. The product had an apparent density of 0.21 g/cm$^3$ and a binder content ratio of 34%. The thickness of the sample at this time was 0.8 mm and the chafing number was 118, which was quite poor.

EXAMPLE 34

The amount of the minute fibers adhered in the sample whose binder content ratio was 34% of Example 33, was measured by the minute fiber adhesion method. The value was 73 mg.

CONTROL 20

Example 33 was repeated except for omitting the heat treatment. The amount of minute fiber adhered, in the resulting sample having a binder content ratio of 33%, was measured. The value was 213 mg. which was increased remarkably as compared to the value in Example 34.

In a multi-component fiber according to the present invention, for example, an islands-in-a-sea type composite fiber, when polyethylene terephthalate is used as the island component, when the draw ratio is raised, a filament is obtained which is unlikely to contract. When a woven fabric having a superfine nap is made using such a composite fiber, the destruction of the sea component at the time of spinning is small as compared to a conventional islands-in-a-sea type composite fiber using a sea component consisting of a polymer of the polystyrene series. Because of that, coiling of fibers around the rolls in the drawing step and the spinning step is less, the luster of the nap of the resulting fabric is excellent, the nap is unlikely to curl and, because of that, the fabric has an excellent hand.

Examples of steps for making such woven fabrics are as follows:

1.
   a. Spinning of an islands-in-a-sea type staple fiber to be used as weft;
   b. Woolly processed, latent crimped or ordinary filament yarn, to be used as warp;
   c. Satin fabric is made — 4, 5 and 8-ply;
   d. Contracting treatment or desizing (when the warp was sized, desizing is carried out);
   e. Removal of the sea component (dissolving);
   f. Oiling (for napping) and/or crimp developing treatment (heat treatment);
   g. Napping;
   h. Adding an anti-pilling, balancing agent (a high molecular weight elastomer such as polyurethane) (emulsion or solution) (including solidification and drying);
   i. Napping (buffing);
   j. Dyeing (including reduction washing and/or drying) (An example of reduction washing is use of a dilute hot aqueous solution of sodium hydrosulfite ($Na_3S_2O_4$) and caustic soda (NaOH);
   k. Finishing (imparting a finishing oiling agent, brushing and/or buffing of the back surface).

2.
   a. Spinning of islands-in-a-sea type staple fiber (as weft);
   b. Woolly processed, latent crimped or ordinary filament (as warp);
   c. Satin fabric;
   d. Contracting treatment or desizing;
   e. Removal of sea component;
   f. Oiling and/or crimp developing treatment (heat treatment;
   g. Napping;
   h.. Imparting a sizing agent (drying);
   i. Imparting an anti-pilling balancing agent (emulsion or solution);
   j. Removal of the sizing agent (desizing);
   k. Napping (buffing);
   l. Dyeing and dyeing finishing;
   m. Finish processing of woven fabric.

3.
   a. Spun yarn or filament of an islands-in-a-sea type staple fiber (as a napped fiber);
   b. Spun yarn or filament (as warp and weft of the base);
   c. Seal woven fabric;
   d. Backing (solution or emulsion);

e. Removal of the sea component (preferably buffing the back surface);
f. Dyeing;
g. Finishing (preferably buffing the surface and the back surface).

When the islands-in-a-sea type fiber is highly contractible, the aforesaid step (3) is further improved and the woven fabric made a napped fabric having short nap.

4.
a. Spun yarn or filament of an islands-in-a-sea type staple fiber (as a napped fiber);
b. spun yarn or filament (as warp and weft of the base);
c. Seal woven fabric;
d. Backing;
e. Contracting step after (c) or (d) (for shortening nap);
f. Removal of sea component;
g. Dyeing;
h. Finishing.

EXAMPLE 35

A total 150 denier × 48 filament woolly false twisted yarn of polyethylene terephthalate was used as warp and a spun yarn from an islands-in-a-sea type staple fiber whose island component was polyethylene terephthalate and whose sea component was a copolymer of 72 parts of styrene and 28 parts of 2-ethylhexyl acrylate, was used as weft in weaving a fabric.

Figure 1A:
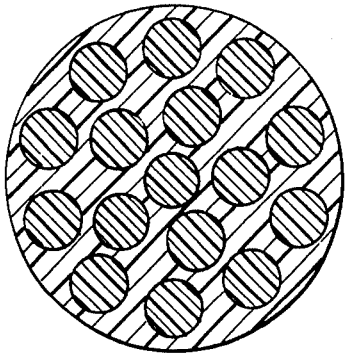
Figure 1B:
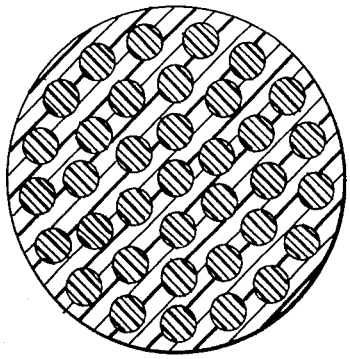

The islands-in-a-sea type staple fiber had the following characteristics:

| | |
|---|---|
| Number of islands | 16 (see FIG. 1) |
| Island component ratio | 55% by weight |
| Sea component ratio | 45% by weight |
| Denier | 3.0 |
| Fiber length | 51 mm |
| Number of crimps | 8 - 12 per inch |

Draw ratio at the time of drawing 3.2.

This staple was spun into a 20/28 spun yarn.

The spinnability at this time was good, the staple fiber was processed favorably through carding, drafting, roving and spinning steps, and coiling of the staple around the card, drafting rollers and spinning rollers took place very seldom, and good spinning could easily be carried out.

Further, the aforesaid yarns were used as warp and weft, respectively, and they were woven into a 5-ply satin fabric to produce a weaving density of 100 warps/in and 60 wefts/in. At this time, an edge of about 1 cm was made and a basket weave was selected as the woven pattern.

The fabric was washed with hot water at 80° C. After it was dried, the fabric was thoroughly washed 5 times with trichloroethylene, and the sea component of the weft was removed. After it was dried, the fabric was passed through hot water containing an ordinary oiling agent for napping, and dried.

The resulting fabric was passed 7 times through a rotary card cloth napping machine to nap the surface, to obtain a napped fabric in which superfine fibers were thoroughly napped. This fabric had wonderful smooth touch. However, it had poor pilling resistance and hand, and the firmness that resulted when it was bent longitudinally was greatly different from that which resulted when it was bent transversely. When it was bent transversely, creases were left behind. The fabric was out of balance.

This fabric was impregnated with a 10% dilute polyurethane emulsion consisting mainly of polylpropylene glycol, toluylene diisocynate and hexamethylene diamine prepared according to known methods of polymerization, namely, according to the method disclosed in Japanese Patent Application Publication No. 1141/1958, and dried. The amount that adhered, calculated as pure polyurethane, was 21 g/cm². The resulting fabric was napped (buffed) by No. 150 mesh sandpaper. The front surface was buffed thrice and the back surface was buffed once by a belt sander buffing machine. As a result of this buffing, the fabric became a suede-like fabric whose surface was covered with compact superfine nap. It was heat treated at 170° C for 3 minutes in hot air.

Next the fabric was dyed in a brown color by a circular type pressure dyeing machine; washed with water, a finishing oiling agent was applied and dried in hot air at 90° C according to known methods. The back surface was buffed to remove ugly naps raised here and there, and the surface was brushed and finished. When the naps were brought down to one side and the fabric was so dried that the surface of the fabric could contact the surface of a dryer roll at 90° C, the fabric developed excellent surface gloss and brilliance.

The resulting fabric was a suede-like fabric, the texture of which was hardly visible, having a wonderfully soft and smooth surface touch and soft hand, and it was so well balanced that any directional difference in hand when it was bent longitudinally and transversely was almost unnoticeable.

Because the fiber was well drawn in this fabric, superfine naps were in evidence, having almost no tendency to be entangled, and they had excellent gloss.

EXAMPLE 36

Example 33 was repeated except for using a polyethylene terephthalate copolymer having a softening point of 231° C, copolymerized with adipic acid in an amount of 11% based on the weight of the polymer, as an island component in fibers used for preparing artificial leather.

The resulting artificial leather was dyed at a temperature of 105° C. The resulting dyed artificial leather had an excellent appearance in which any color difference between the binder and the fiber was virtually undetectable and inconspicuous. The deformation ratio was 7% and the chafing number was 320.

The following is claimed:

1. In a method of making a sheet-like material comprising bundles of fiber forming synthetic polyester fine fibers and a polyurethane binder, the steps which comprise (1) spinning a plurality of multi-component fibers comprising (A) a fiber forming synthetic polyester and (B) a component removable by dissolution in a solvent which does not dissolve the fine fibers comprising component (A), wherein said component (B) comprises substantially a copolymer of styrene and about 10 – 30% by weight of a higher alcohol ester of an acid selected from the group consisting of acrylic acid and methacrylic acid, said higher alcohol containing 6 – 20 carbon atoms and having a boiling point of at least 150° C at 760 mm Hg, (2) making a primary sheet material from said multi-component fibers, (3) impregnating said primary sheet material with a water soluble sizing agent, (4) dissolving out component (B) to make an intermediate sheet material comprising bundles of fiber forming synthetic polyester fine fibers and the water soluble sizing agent, (5) combining said bundles with a polyurethane binder, and (6) removing said water soluble sizing agent.

2. In a method of making a sheet-like material comprising bundles of fiber forming synthetic polyester fine fibers and a polyurethane binder, the steps which comprise (1) spinning a plurality of multi-component fibers comprising (A) a fiber forming synthetic polyester and (B) a component removable by dissolution in a solvent which does not dissolve the fine fibers comprising component (A), wherein said component (B) comprises substantially a copolymer of styrene and about 10 – 30% by weight of a higher alcohol ester of an acid selected from the group consisting of acrylic acid and methacrylic acid, said higher alcohol containing 6 – 20 carbon atoms and having a boiling point of at least 150° C at 760 mm Hg, (2) making a primary sheet material from said multi-component fibers, (3) dissolving out component (B) to make an intermediate sheet material comprising bundles of fiber forming synthetic polyester fine fibers, and (4) combining said bundles with a polyurethane binder.

3. A multi-component fiber comprising at least two components (A) and (B) as defined hereinafter, wherein component (B) is removable by dissolution in a solvent, wherein component (A) consists essentially of fine fibers which are not dissolved by said solvent, wherein said component (B) comprises substantially a copolymer of styrene and about 10 – 30% by weight of a higher alcohol ester of an acid selected from the group consisting of acrylic acid and methacrylic acid, said higher alcohol containing 6 – 20 carbon atoms and having a boiling point of at least 150° C at 760 mm Hg, and wherein said component (A) comprises substantially a fiber forming synthetic polyester.

4. A multi-component fiber according to claim 3, wherein said higher alcohol ester is selected from the group consisting of 2-ethylhexyl acrylate and stearyl methacrylate.

5. A multi-component fiber according to claim 3, wherein the shrinkage of said fiber in hot water at 90°C is at least 15%.

6. A multi-component fiber according to claim 3, which has the construction and arrangement of an islands-in-sea composite fiber.

7. A multi-component fiber according to claim 3, wherein said fiber forming synthetic polyester is a polyethylene terephthalate copolymer containing an acid unit selected from the group consisting of isophthalic acid and adipic acid units in an amount ranging from about 4.5% to 20% based on the weight of the polyester.

8. A multi-component fiber according to claim 7, wherein the shrinkage of said fiber in hot water at 90° C is at least 25%.

9. A multi-component fiber according to claim 8, wherein the two-stage contractibility of said fiber is at least 60%.

10. A method of making a multi-component fiber comprising at least two components (A) and (B), wherein component (B) is removable by dissolution in a solvent therefrom, wherein component (A) consists essentially of fine fibers which are not dissolved by said solvent, wherein said component (B) comprises mainly a copolymer of styrene and about 10 – 30% by weight of a higher alcohol ester of an acid selected from the group consisting of acrylic acid and methacrylic acid, the alcohol containing 6 – 20 carbon atoms and having a boiling point of at least 150° C at 760 mm Hg, and wherein said other component (A) comprises mainly a fiber forming synthetic polyester, the steps which comprise spinning said components into a multi-component fiber and drawing the fiber at least 2.6 times at a drawing temperature not more than about 100° C.

11. A method according to claim 10, wherein the spinning step comprises mixing the components (A) and (B) and spinning the mixture from a spinning orifice.

* * * * *